US011345055B2

(12) United States Patent
Long et al.

(10) Patent No.: US 11,345,055 B2
(45) Date of Patent: May 31, 2022

(54) RAZOR CARTRIDGE STRUCTURE

(71) Applicant: The Gillette Company LLC, Boston, MA (US)

(72) Inventors: Matthew Michael Long, Methuen, MA (US); Jahdiel Fyfield, Roslindale, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/122,164

(22) Filed: Sep. 5, 2018

(65) Prior Publication Data

US 2020/0070374 A1 Mar. 5, 2020

(51) Int. Cl.
*B26B 21/40* (2006.01)
*B26B 21/52* (2006.01)

(52) U.S. Cl.
CPC ..... *B26B 21/4018* (2013.01); *B26B 21/521* (2013.01)

(58) Field of Classification Search
CPC ..... B26B 21/00; B26B 21/06; B26B 21/14; B26B 21/22; B26B 21/4012; B26B 21/4018
USPC ..... 30/47–51, 55, 59, 60, 65, 73, 74.1, 30/77–83; D28/44–48
See application file for complete search history.

(56) References Cited

U.S. PATENT DOCUMENTS 3,935,639 A 2/1976 Terry et al.
3,939,560 A * 2/1976 Lyall ..... B26B 21/40 30/81
3,950,849 A 4/1976 Perry
4,094,063 A 6/1978 Trotta
4,146,958 A * 4/1979 Chen ..... B26B 21/4018 30/47
4,198,746 A 4/1980 Trotta
4,266,340 A 5/1981 Bowman
RE30,913 E * 4/1982 Cartwright ..... B26B 21/4012 30/47
4,392,303 A 7/1983 Ciaffone
4,514,904 A 5/1985 Bond
4,599,793 A 7/1986 Iten
(Continued)

FOREIGN PATENT DOCUMENTS

WO 2010065366 A1 6/2010

OTHER PUBLICATIONS

International Search Report and Written Opinion; Application Ser. No. PCT/US2019/049626; dated Nov. 19, 2019, 11 pages.

*Primary Examiner* — Jason Daniel Prone
(74) *Attorney, Agent, or Firm* — Joanne N. Pappas; Kevin C. Johnson

(57) ABSTRACT

A cartridge for a razor is provided. The cartridge may have a housing including first and second opposed end portions spaced apart in a lateral direction of the cartridge, which lateral direction is parallel to one or more blades provided in the housing; front and back portions spaced apart in a longitudinal direction of the cartridge; and a structure defining at least one of the front portion or the back portion. The structure may include a plurality of the first protrusions extending from a base of the structure. The structure may further include a plurality of second protrusions extending from the base of the structure. One or more of the first protrusions may be positioned between at least one set of adjacent ones of the second protrusions.

23 Claims, 13 Drawing Sheets

(56) References Cited

U.S. PATENT DOCUMENTS 4,756,082 A 7/1988 Apprille, Jr.
4,785,534 A 11/1988 Lazarchik
4,854,043 A * 8/1989 Chen ..... B26B 21/4018 30/50
4,976,028 A * 12/1990 Chen ..... B26B 21/4018 30/49
5,003,694 A * 4/1991 Chen ..... B26B 21/4081 30/49
5,031,316 A * 7/1991 Oldroyd ..... B26B 21/4012 30/47
5,157,834 A 10/1992 Chen et al.
5,333,383 A 8/1994 Ferraro
5,347,717 A 9/1994 Ts
5,386,750 A * 2/1995 Morrison ..... B26B 21/42 30/31
5,412,872 A * 5/1995 Iderosa ..... B26B 21/4012 30/50
5,475,923 A * 12/1995 Ferraro ..... B26B 21/4018 30/51
5,501,014 A * 3/1996 Hegemann ..... B26B 21/4068 30/50
5,802,721 A * 9/1998 Wain ..... B26B 21/4018 30/82
D402,084 S * 12/1998 Chen ..... D28/47
5,953,819 A * 9/1999 Simms ..... B26B 21/4018 30/77
6,035,535 A * 3/2000 Dischler ..... B26B 21/225 30/48
6,112,412 A 9/2000 Richard
6,167,625 B1 * 1/2001 King ..... B26B 21/4018 30/77
6,298,557 B1 * 10/2001 Gilder ..... B26B 21/4018 30/81
6,311,400 B1 11/2001 Hawes et al.
6,421,925 B1 7/2002 Wonderley
D467,387 S * 12/2002 Wonderley ..... D28/45
6,516,518 B1 * 2/2003 Garraway ..... B26B 21/4018 30/81
6,675,479 B1 * 1/2004 Walker, Jr. ..... B26B 21/4018 30/74.1
6,854,188 B1 2/2005 Wonderley
6,880,253 B1 4/2005 Gyllerstrom
6,941,659 B2 * 9/2005 Gilder ..... B26B 21/4018 30/77
7,140,116 B2 11/2006 Coffin
7,152,512 B1 12/2006 Prochaska
7,200,942 B2 4/2007 Richard
7,331,107 B2 2/2008 Follo et al.
7,461,458 B2 12/2008 Peyser et al.
7,526,869 B2 5/2009 Blatter et al.
7,574,809 B2 8/2009 Follo et al.
D608,501 S * 1/2010 Wain ..... D28/47
D625,049 S * 10/2010 Bridges ..... D28/47
D630,797 S * 1/2011 Witkus ..... D28/47
7,874,076 B2 1/2011 Gratsias et al.
D633,254 S * 2/2011 Witkus ..... D28/47
D636,532 S * 4/2011 Jessemey ..... D28/47
8,033,023 B2 10/2011 Johnson et al.
D653,395 S * 1/2012 Adams ..... D28/47
8,151,472 B2 4/2012 Dimitris et al.
D658,809 S * 5/2012 Jessemey ..... D28/47
8,186,062 B2 * 5/2012 Fischer ..... B26B 21/4018 30/81
D665,948 S * 8/2012 Jessemey ..... D28/47
8,359,751 B2 1/2013 Efthimiadis et al.
8,359,752 B2 * 1/2013 Bridges ..... B26B 21/4018 30/50
8,413,334 B2 * 4/2013 Walker, Jr. ..... B26B 21/4018 30/50
8,590,162 B2 11/2013 Park et al.
D699,892 S * 2/2014 Wonderley ..... D28/47
8,726,518 B2 * 5/2014 Bruno ..... B26B 21/4018 30/74.1
8,844,145 B2 9/2014 Psimadas et al.
9,221,185 B2 * 12/2015 Walker, Jr. ..... B26B 21/4018
9,492,933 B2 * 11/2016 Wain ..... B26B 21/4018
D776,875 S * 1/2017 Ren ..... D28/47
9,694,503 B2 7/2017 Papadopoulos-papageorgis et al.
D829,380 S * 9/2018 Kong ..... D28/47
D843,058 S * 3/2019 Fyfield ..... D28/46
D843,060 S 3/2019 Fyfield et al.
10,493,644 B2 12/2019 Bozikis et al.
D874,725 S * 2/2020 Riehle ..... D28/46
D874,727 S * 2/2020 Washington ..... D28/47
D886,380 S * 6/2020 Washington ..... D28/47
D890,995 S * 7/2020 Long ..... D28/47
D905,908 S * 12/2020 Washington ..... D28/47
D940,394 S * 1/2022 Fyfield ..... D28/47
2002/0000040 A1 * 1/2002 Gilder ..... B26B 21/4018 30/77
2003/0046817 A1 * 3/2003 Coffin ..... B26B 21/227 30/50
2003/0046819 A1 3/2003 Ferraro et al.
2004/0025350 A1 * 2/2004 Richard ..... B26B 21/227 30/50
2004/0181954 A1 9/2004 Follo et al.
2005/0039338 A1 2/2005 King et al.
2005/0246898 A1 * 11/2005 Gilder ..... B26B 21/4018 30/34.2
2007/0028449 A1 2/2007 King
2008/0115366 A1 5/2008 Follo et al.
2008/0189964 A1 8/2008 Bozikis et al.
2009/0038167 A1 2/2009 Peyser et al.
2009/0199406 A1 8/2009 Gratsias et al.
2010/0005669 A1 1/2010 Winter et al.
2010/0058595 A1 3/2010 Walker, Jr. et al.
2011/0094108 A1 * 4/2011 Wain ..... B26B 21/4018 30/77
2012/0124840 A1 5/2012 Iaccarino et al.
2012/0192431 A9 * 8/2012 Wain ..... B26B 21/4018 30/50
2013/0081276 A1 4/2013 Wain et al.
2013/0205595 A1 * 8/2013 Bykowski ..... B26B 21/14 30/64
2014/0059862 A1 3/2014 Efthimiadis et al.
2014/0068953 A1 3/2014 Wonderley
2015/0314467 A1 11/2015 Bridges et al.
2016/0121495 A1 5/2016 Johnson
2016/0129603 A1 5/2016 Antoniou
2016/0144519 A1 5/2016 Hahn et al.
2016/0158948 A1 * 6/2016 Eagleton ..... B26B 21/4018 30/34.2
2016/0250765 A1 9/2016 Gratsias et al.
2018/0236677 A1 * 8/2018 Blatter ..... B26B 21/44
2019/0299457 A1 * 10/2019 Long ..... B26B 21/4012
2019/0337174 A1 11/2019 Kopelas et al.
2019/0351568 A1 * 11/2019 Kim ..... B26B 21/4012
2019/0366570 A1 12/2019 Kopelas et al.
2019/0375123 A1 * 12/2019 Park ..... B26B 21/4018
2020/0009754 A1 1/2020 Provost et al.
2020/0070375 A1 * 3/2020 Hurtado ..... B26B 21/225
2021/0162613 A1 * 6/2021 Efthimiadis ..... B26B 21/4012
2021/0170615 A1 * 6/2021 Son ..... B26B 21/4018
2021/0245378 A1 * 8/2021 Blatter ..... B26B 21/222
2021/0339413 A1 * 11/2021 Ren ..... B26B 21/14

* cited by examiner

RAZOR CARTRIDGE STRUCTURE

FIELD OF THE INVENTION

This invention relates to razors, and more particularly to an improved guard structure.

BACKGROUND OF THE INVENTION

A shave razor cartridge is usually composed of a cartridge housing, blades having cutting edges, a guard structure in front of the blades and a cap structure, which may include a shaving aid or lubricating strip, disposed behind the blades. Each component plays a unique role during shaving.

A guard structure of a razor cartridge typically includes fins or protrusions, disposed in front of the blades to engage the skin's surface by stimulating and stretching the skin in front of the blades, tending to improve comfort while also properly positioning the skin for cutting of hairs.

It would be desirable for a guard structure to provide improved shaving performance attributes such as skin management, comfort, efficiency, and safety.

SUMMARY OF THE INVENTION

In accordance with an aspect of the present disclosure, a cartridge for a razor is provided. The cartridge may comprise a housing comprising: first and second opposed end portions spaced apart in a lateral direction of the cartridge, which lateral direction is parallel to one or more blades provided in the housing; front and back portions spaced apart in a longitudinal direction of the cartridge; and a structure defining at least one of the front portion or the back portion. The structure may comprise: a plurality of first protrusions extending from a base of the structure, the first protrusions having a direction of elongation in a longitudinal direction. Each of the first protrusions may define: a width in the lateral direction; a length in the longitudinal direction; a height in a Z-direction, wherein the Z-direction is perpendicular to both the lateral and longitudinal directions; and a peak at a highest point of a tip of the protrusion as measured in the Z-direction. The peak is located at a first distance greater than zero from the base of the structure. The structure may further comprise a plurality of second protrusions extending from the base of the structure. The second protrusions may have a direction of elongation in the longitudinal direction. Each of the second protrusions may define: a width in the lateral direction; a length in the longitudinal direction; a height in the Z-direction; and a peak at a highest point of a tip of the protrusion as measured in the Z-direction. The peak may be located at a second distance greater than zero from the base of the structure. The first distance may be greater than the second distance such that the heights of the plurality of first protrusions are greater than the heights of the plurality of second protrusions. One or more of the first protrusions may be positioned between at least one set of adjacent ones of the second protrusions.

In accordance with another aspect of the present disclosure, a cartridge for a razor is provided. The cartridge may comprise a housing comprising first and second opposed end portions spaced apart in a lateral direction of the cartridge, which lateral direction is parallel to one or more blades provided in the housing; front and back portions spaced apart in a longitudinal direction of the cartridge; and a structure defining at least one of the front portion or the back portion. The structure may comprise a plurality of first protrusions extending from a base of the structure. The first protrusions may have a direction of elongation and a first length in the longitudinal direction, a first width in a lateral direction and a first height in a Z-direction, wherein the Z-direction is perpendicular to both the lateral and longitudinal directions. The structure may further comprise a plurality of second protrusions extending from the base of the structure. The second protrusions may have a direction of elongation and a second length in the longitudinal direction, a second width in the lateral direction and a second height in the Z-direction. The second length may be less than the first length. One or more of the first protrusions may be positioned between at least one set of adjacent ones of the second protrusions.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1:
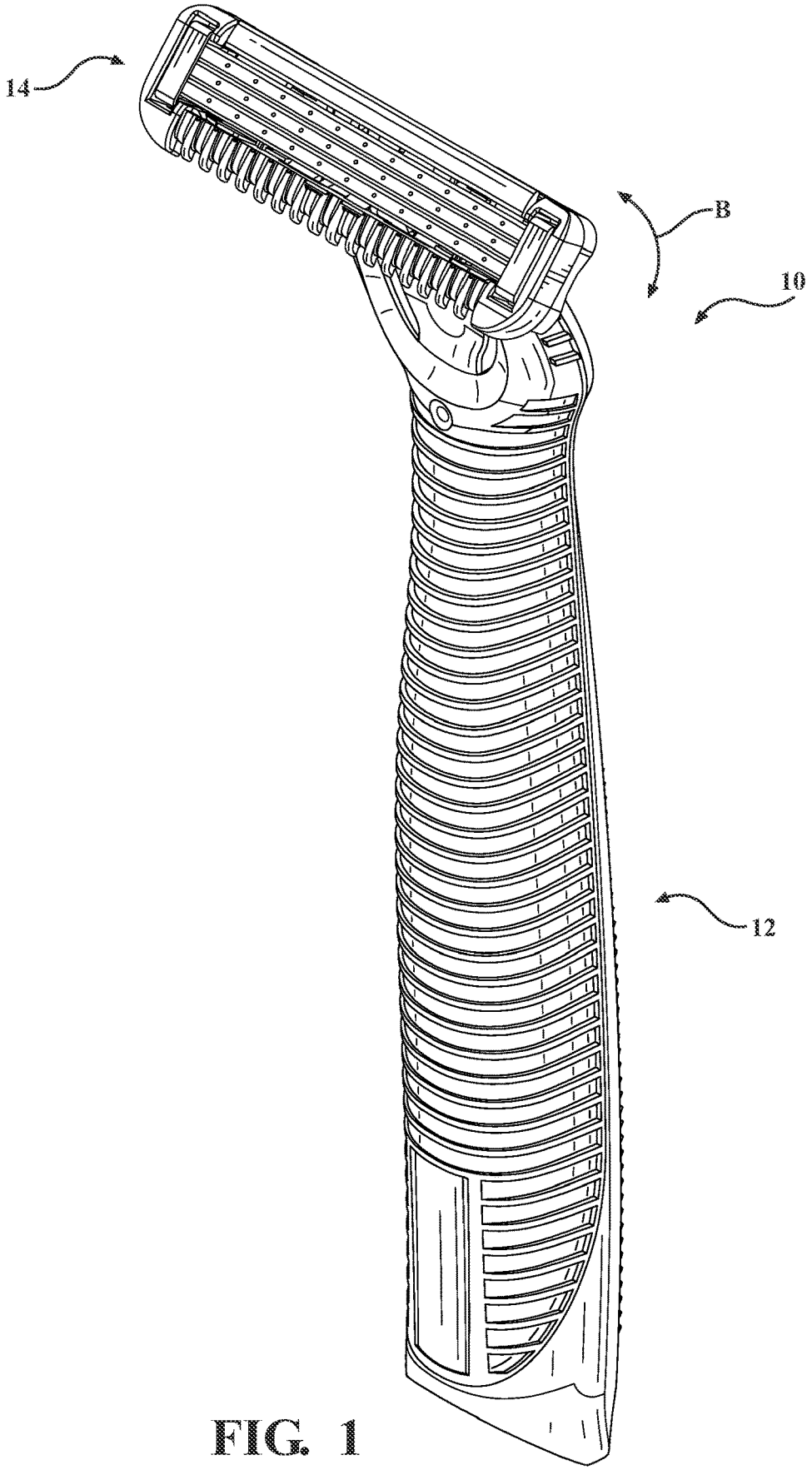
FIG. 1 is a perspective view of a shaving razor in accordance with the present disclosure.

Except as otherwise noted, the articles "a," "an," and "the" mean "one or more."

Choosing materials, properties and configurations for an appropriate lower cost guard structure (e.g., generally defined as the area in front of the blades), leveraging the synergistic effect between the guard structure, the skin and the blades, may be desirable for providing beneficial shaving performance attributes, such as consistent shave closeness and comfort during wet shaving.

In the present invention, the term "guard structure" signifies a physical structure which may engage, hold, or stretch a user's skin for skin management during shaving and may be comprised of, though not limited to, one or more fin elements, elongated filaments or protrusions, or nubs. The guard structure may generally be upstanding or curved, rigid or flexible, may have planar or non-planar surfaces, may be contiguous, non-contiguous, patterned, or any combination thereof. It may be made by injection molding techniques for low cost and manufacturing simplicity of using a single material (e.g., as the housing).

The guard structure of the present invention is preferably comprised of hard plastic material comprised of polystyrene, polyphenylene oxide, polypropelene, acrylonitrile butadiene styrene, or high impact polystyrene or materials that are not flexible.

However, it is contemplated in the present invention that the guard structure alternatively may have portions or be wholly comprised of any type of material such as, but not limited to, polystyrene, elastomers, rubbers or other polymers. Elastomers such as silicone, fluorosilicone, polyisoprene, polybutadiene, polyisobutylene, copolymers such as styrene-ethylene-butylene-styrene (SEBS) based thermoplastic elastomer, styrene-ethylene-propylene-styrene (SEPS) based thermoplastic elastomer, polyoxyethylene-polyurethane based elastomer, or rubbers such as acrylonitrile-butadiene, polyacrylate and natural rubber, or other polymers such as polyurethane, polystyrene and polyethylene, or any combination thereof are also contemplated in the present invention. Additionally, the guard structure material may include modifications of one or more of the above-listed materials (e.g., polymers and rubbers and their composites) with other materials. Finally, the materials may include textile or fabric materials, natural materials (e.g., wood), or metals coated with elastomeric or plastic materials.

Referring to FIGS. 1-4, a shaving razor 10 may comprise a razor handle 12 and a razor cartridge 14, which may be releasably coupled to the handle 12. The razor cartridge 14 may comprise a housing 16 that includes a front portion 21, a back portion 23, a first end portion 25, a second end portion 27, a top portion 26, and a bottom portion or underside 28. The front and back portions 21, 23 are spaced apart in a longitudinal direction of the cartridge 14, as shown by line $L_1$; the first and second end portions 25, 27 are spaced apart in a lateral direction of the cartridge 14, as shown by line $L_2$; and the top and bottom portions 26, 28 are spaced apart in a Z-direction of the cartridge 14, as shown by line $L_3$. Line $L_1$ may define a minor axis of the cartridge 14, and line $L_2$ may define a major axis of the cartridge 14.

The front portion 21 of the housing 16 comprises a guard structure 18, and the back portion 23 comprises a cap structure 19 that may include one or more lubricating and/or moisturizing strips 20. The housing 16 may carry one or more blades 22 extending in the lateral direction. The housing 16 of the cartridge 14 includes the guard structure 18 and, hence, may be formed from any of the materials set out above from which the guard structure 18 is formed. Clips 24 disposed on the first and second end portions 25, 27 of the cartridge 14 assist in retaining the blades 22 in the housing 16. The cartridge 14 may be coupled to the handle 12 via one or more shell bearings, wherein the embodiment illustrated in FIGS. 5 and 6 comprises first and second shell bearings 38, 40, or any other feasible mechanism, and the cartridge 14 may pivot relative to the handle 12, as described in more detail below.

Figure 5:
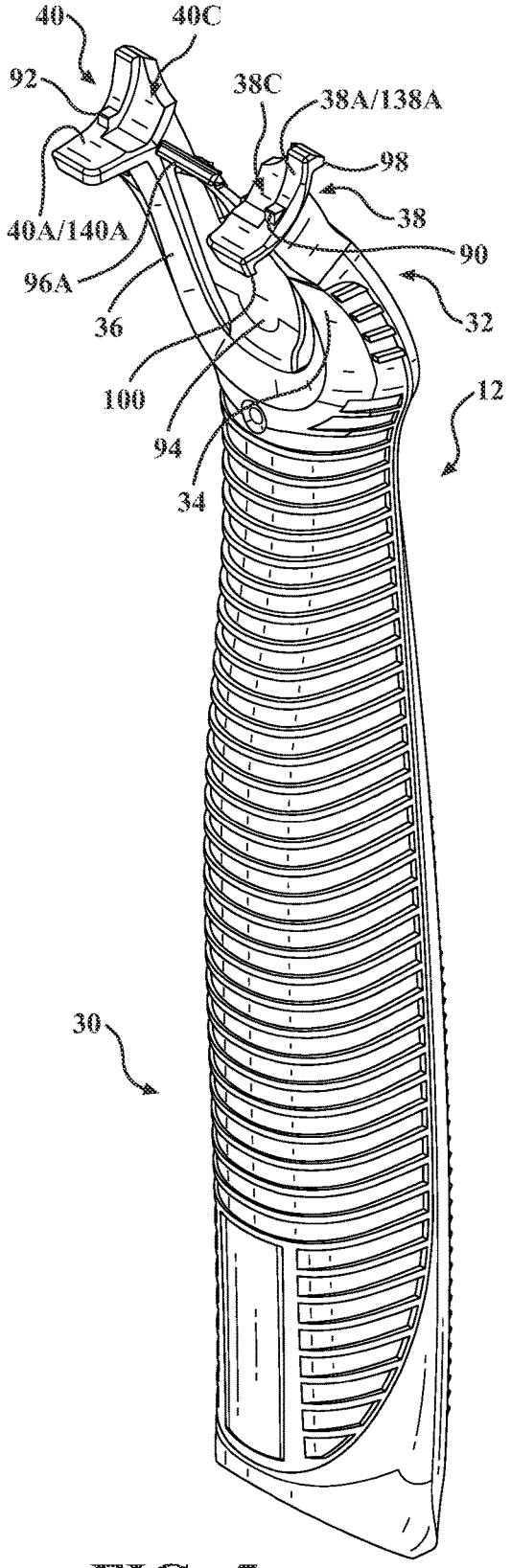
FIG. 5 is a perspective view of a razor handle of the shaving razor of FIG. 1.
Figure 6:
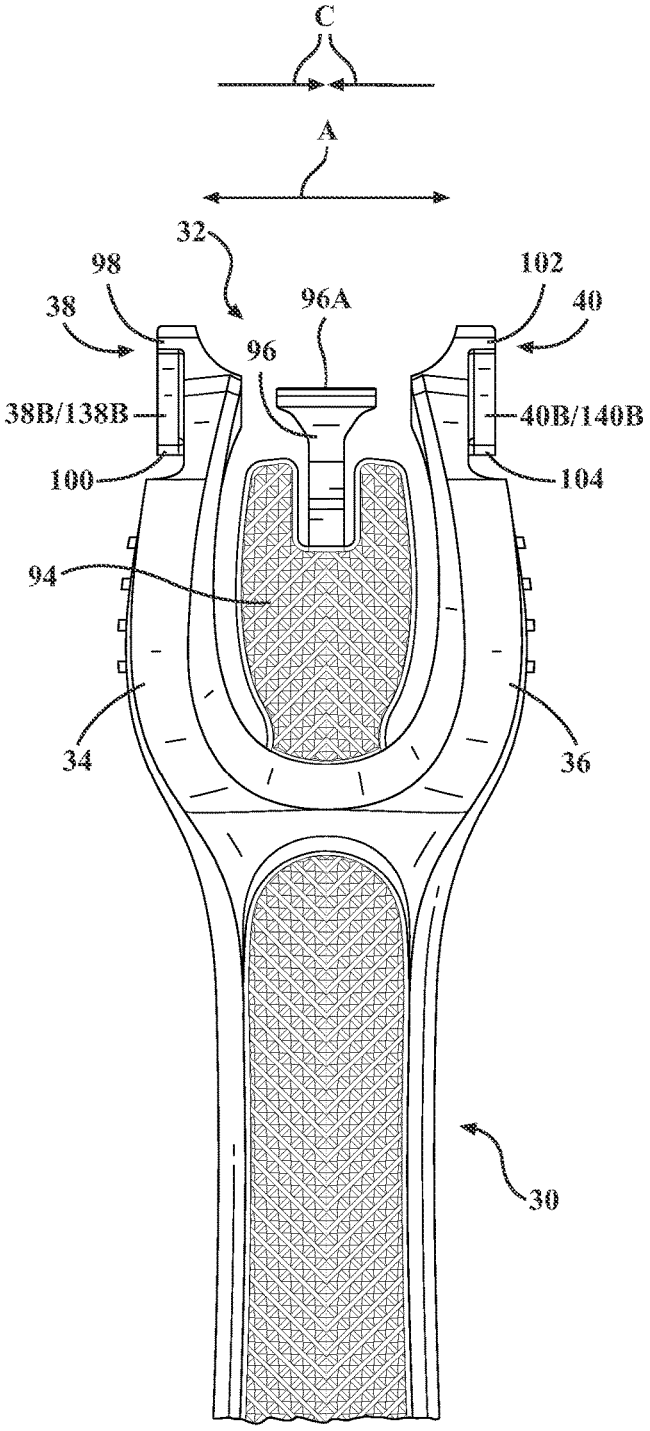
FIG. 6 is a back view of a portion of the razor handle of FIG. 5.

With reference to FIGS. 5 and 6 in which the razor cartridge 14 has been removed, the handle 12 may comprise a main body 30 and a head 32 at one end of the main body 30. The main body 30 may comprise an elongated structure that may be partially hollow. The head 32 may comprise a first arm 34 and a second arm 36, each of which is integral with and extends from the main body 30. The arms 34, 36 may be movable relative to one another in a direction indicated by arrows A and C to allow the cartridge 14 to be releasably coupled to the handle 12, as described in more detail below. The main body 30 and the head 32 may comprise a polymeric material including, but not limited to polypropylene, polyethylene, and acrylonitrile butadiene styrene polymers. Portions of the main body 30 and/or the head 32 may comprise a softer gripping material (not separately labeled) with a plurality of grooves. The gripping material may comprise a polymeric material including, but not limited to a thermoplastic elastomer.

As discussed further below, the head 32 comprises one or more inner bearing surfaces and one or more outer bearing surfaces for pivotally engaging the cartridge 14. As shown in FIGS. 5 and 6, the first arm 34 may comprise the first shell bearing 38 coupled to an end of the first arm 34 opposite the main body 30, and the second arm 36 may comprise the second shell bearing 40 coupled to an end of the second arm 36 opposite the main body 30. The first shell bearing 38 comprises an inner surface 38A that defines a first inner bearing surface 138A and an outer surface 38B that defines a first outer bearing surface 138B. The second shell bearing 40 comprises an inner surface 40A that defines a second inner bearing surface 140A and an outer surface 40B that defines a second outer bearing surface 140B. The inner surfaces 38A, 40A of the first and second shell bearings 38, 40 may each optionally comprise an undercut recess 38C, 40C.

The handle 12 may further comprise a center extension 94 and spring-biased member 96 extending outwardly from the center extension 94, wherein both the extension 94 and spring-biased member 96 are located between the arms 34, 36. The spring-biased member 96 is flexible and comprises a tab 96A at its outermost end opposite the extension 94 and main body 30. Because the spring-biased member 96 is flexible, the tab 96A is capable of flexing in the longitudinal direction (see FIGS. 2 and 4) so as to move with the cartridge 14 as it pivots relative to the handle 12, specifically with respect to the head 32, in a direction indicated by arrow B in FIG. 1. The outer bearing surfaces 138B, 140B may comprise a substantially continuously curved surface, and one or more outer stops 98, 100, 102, 104 may be disposed on one or more of the outer bearing surfaces. As described in more detail in concurrently filed, commonly assigned U.S. Patent Application entitled RAZOR STRUCTURE, filed on the same day as the present application, one or more protrusions 90, 92 disposed on one or more of the inner bearing surfaces 138A, 140A may define one or more inner bearing stops.

Figure 2:
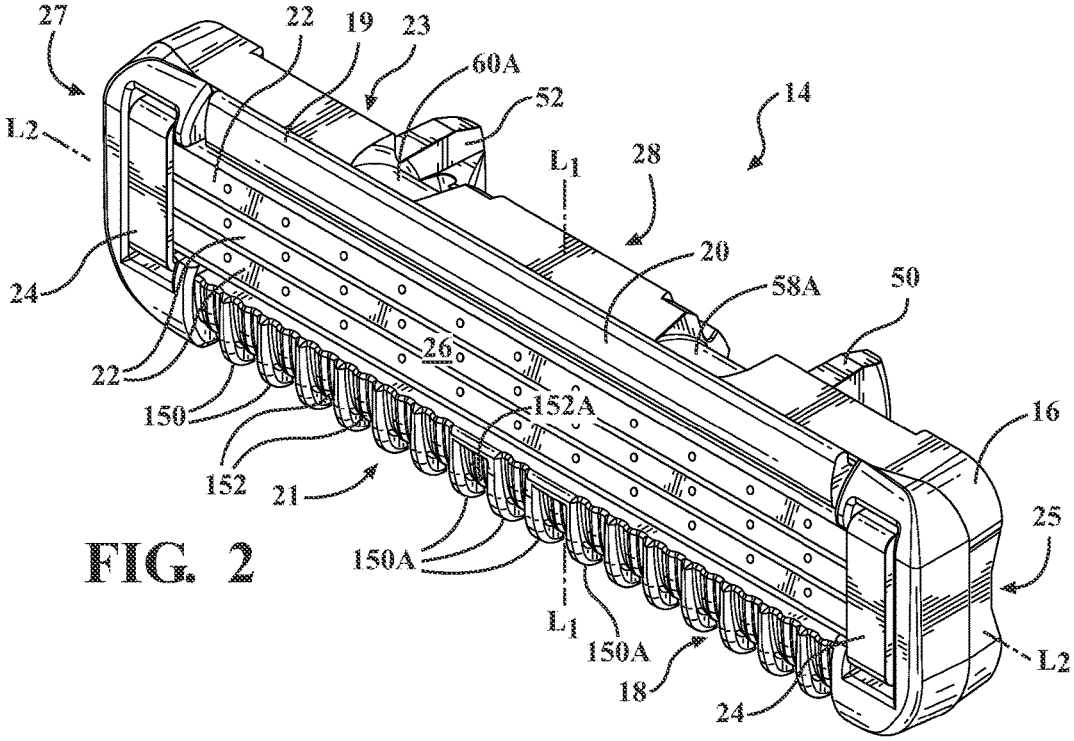
FIG. 2 is a perspective view of a razor cartridge of the shaving razor of FIG. 1.
Figure 3:
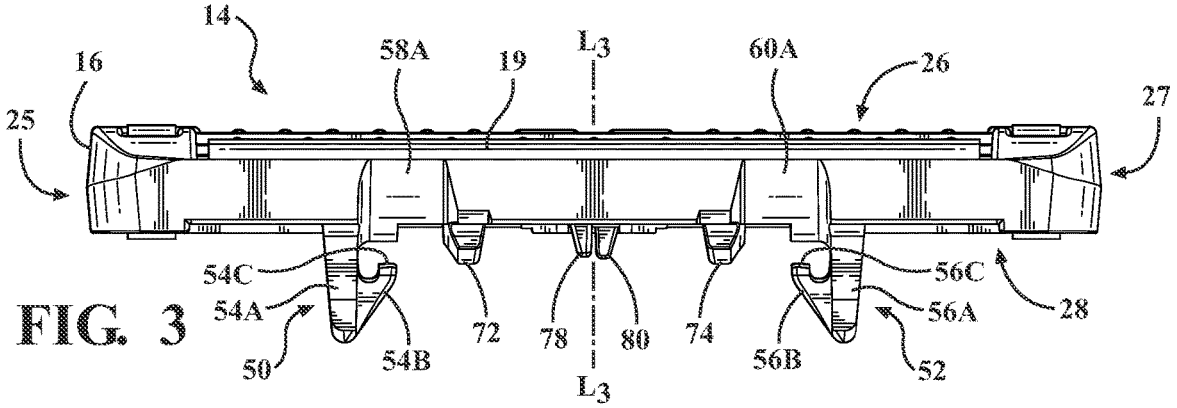
FIG. 3 is a plan view of a back portion of the razor cartridge of FIG. 2.
Figure 4:
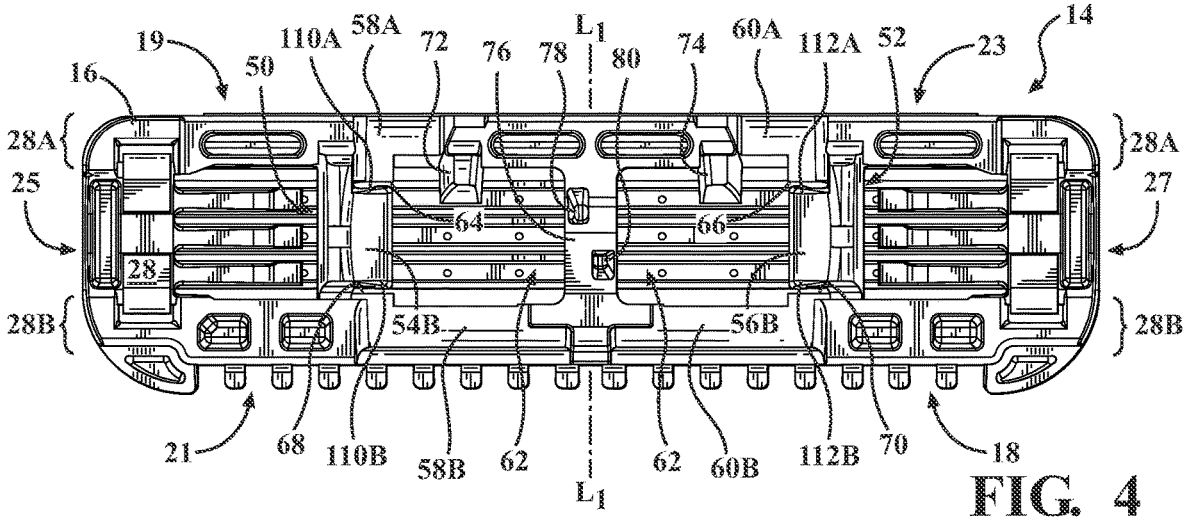
FIG. 4 is a plan view of a bottom portion of the razor cartridge of FIG. 2, in which the blades have been removed.

As shown in FIGS. 2-4, the bottom portion 28 of the housing 16 of the razor cartridge 14 comprises one or more handle engaging surfaces and/or structures. For example, the housing 16 comprises one or more extensions, wherein first and second extensions 50, 52 are provided in the illustrated embodiment, extending outward from the bottom portion 28. The first extension 50 comprises a support portion 54A extending outwardly from and integral with the bottom portion 28 and a first engagement rail 54B having a first inwardly facing, curved engagement surface 54C. The second extension 52 comprises a second support portion 56A extending outwardly from and integral with the bottom portion 28 and a second engagement rail 56B having a second inwardly facing, curved engagement surface 56C. As will be discussed further below, when the cartridge 14 is mounted to the handle 12, the first and second engagement surfaces 54C and 56C engage and are capable of moving along the first and second outer bearing surfaces 138B and 140B of the first and second shell bearings 38 and 40.

With reference to FIGS. 3 and 4, a first section 28A of the bottom portion 28 of the housing 16 adjacent to the cap structure 19 comprises first and second curved upper cartridge bearing surfaces 58A, 60A, and a second section 28B of the bottom portion 28 of the housing 16 adjacent to the guard structure 18 comprises first and second curved lower cartridge bearing surfaces 58B, 60B. The upper and lower cartridge bearing surfaces 58A, 58B, 60A, 60B are also referred to herein as inner cartridge bearing surfaces. As shown in FIG. 4, an opening 62 may be defined by the housing 16 such that the upper cartridge bearing surfaces 58A, 60A are spaced apart from and discontinuous with the lower cartridge bearing surfaces 58B, 60B.

The upper cartridge bearing surfaces 58A, 60A may each comprise an upper projection 64, 66 (also referred to herein as "handle engaging surfaces") that extends in the longitudinal direction into the opening 62 toward the lower cartridge bearing surfaces 58B, 60B. The lower cartridge bearing surfaces 58B, 60B may each comprise a lower projection 68, 70 (also referred to herein as "handle engaging surfaces") that extends in the longitudinal direction into the opening 62 toward the upper cartridge bearing surfaces 58A, 60A. One or more additional projections 72, 74 may be formed on a portion of the housing 16 adjacent to the cap structure 19. The projections 72, 74 may extend outward from the bottom portion 28 of the housing 16 in the Z-direction and may also extend in the longitudinal direction into the opening 62 toward the lower cartridge bearing surfaces 58B, 60B.

A cam structure 76 extends between the first and second sections 28A and 28B of the bottom portion 28 of the housing 16 and across the opening 62. Extending outward from the cam structure 76 in the Z-direction of the cartridge 14 are an upper extension 78 and a lower extension 80. The upper and lower extensions 78, 80 are adapted to be engaged by the tab 96A of the spring-biased member 96 when the cartridge 14 is mounted to the handle 12, as will be discussed further below. As shown in FIG. 4, the upper and lower extensions 78, 80 may be spaced apart in the longitudinal direction. The upper and lower extensions 78, 80 may also be offset from each other in the lateral direction. As described in more detail below, the guard structure 18 of the cartridge 14 may comprise a plurality of first and second protrusions 150, 152. As also described in more detail below, four of the first protrusions, referenced by 150A, and referred to herein as "unique first protrusions" 150A, have a slightly different shape from the remaining or standard first protrusions 150. Two of the second protrusions, referenced by 152A, and referred to herein as "unique second protrusions" 152A, have a slightly different shape from the remaining or standard second protrusions 152.

With reference to FIGS. 1 and 3-7, the razor cartridge 14 may be installed on the handle 12, for example, by a user moving the arms 34, 36 toward each other in the direction indicated by the arrows C in FIG. 6 and pushing the head 32 of the handle 12 against the bottom portion 28 of the cartridge 14. The first inner bearing surface 138A defined by the inner surface 38A of the first shell bearing 38 receives the inner cartridge bearing surfaces 58A, 58B located toward the first end portion 25 of the cartridge 14, and the outer surface 38B of the first shell bearing 38 is received in and engages with the first inwardly facing, curved engagement surface 54C of the first extension 50. The second inner bearing surface 140A defined by the inner surface 40A of the second shell bearing 40 receives the inner cartridge bearing surfaces 60A, 60B located toward the second end portion 27 of the cartridge 14, and the outer surface 40B of the second shell bearing 40 is received in and engages with the second inwardly facing, curved engagement surface 56C of the second extension 52. A curvature of the inner and outer surfaces 38A, 40A, 38B, 40B of the first and second shell bearings 38, 40 may substantially correspond to a curvature of the cartridge bearing surfaces 58A, 60A, 58B, 60B and the curved engagement surfaces 54C, 56C so that the cartridge 14 is able to pivot smoothly relative to the handle 12, specifically with respect to the head 32, in a direction indicated by arrow B in FIG. 1. The projections 72, 74 are received in respective ones of the undercut recesses 38C, 40C formed in the inner surfaces 38A, 40A of the shell bearings 38, 40.

Figure 7:
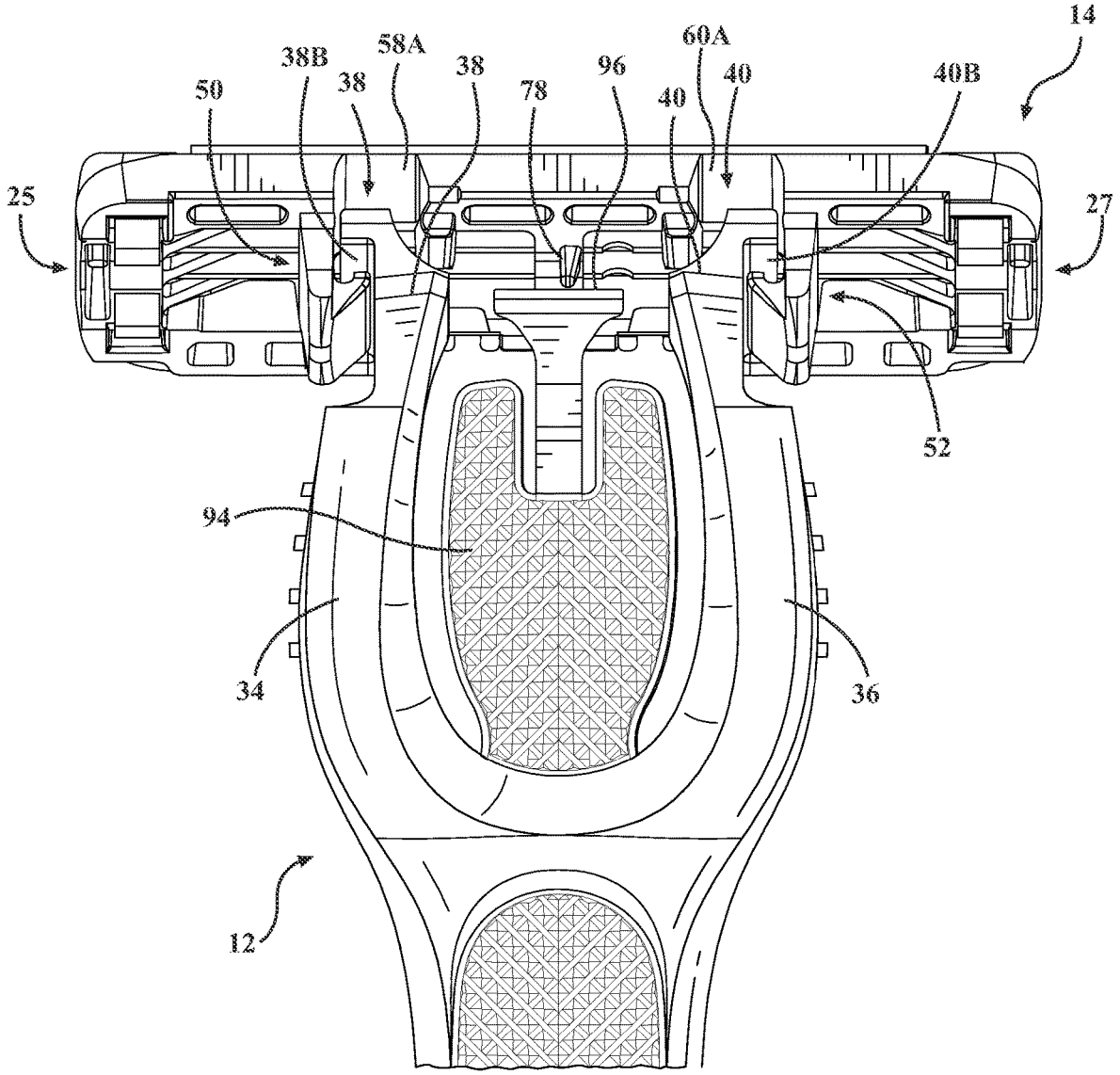
FIG. 7 is a back view of a portion of the shaving razor of FIG. 1.

The tab 96A of the spring-biased member 96 is received between the upper and lower extensions 78, 80 formed on the cam structure 76 and acts against the upper and lower extensions 78, 80 to urge the razor cartridge 14 to a given position, e.g., a home position as shown in FIG. 1 (see also FIG. 7). During use, the cartridge 14 is allowed to pivot as it moves along and follows the contour of a portion of a user's body, e.g., face, due to the flexibility of the spring-biased member 96. When the cartridge 14 is removed from the user's skin, the spring-biased member 96 returns the cartridge 14 to its home position relative to the handle 12.

As noted above, the guard structure 18 of the cartridge 14 may comprise a plurality of first and second protrusions 150, 152. The first and second protrusions 150, 152 preferably cover most of, if not the entirety of, the lateral dimension of the guard structure 18. The first and second protrusions 150, 152 may be integral with the remaining portions of the guard structure and, hence, are formed from the same materials set out above from which the guard structure is formed.

With reference to FIGS. 8A-8D, 9 and 10, the exemplary guard structure 18 comprises a plurality of first protrusions 150 and a plurality of second protrusions 152. The first and second protrusions 150, 152 may be arranged in a pattern, such as alternating first and second protrusions 150, 152 as shown in FIGS. 8A-8D, 9 and 10, i.e., one first protrusion 150, then one second protrusion 152, then one first protrusion 150, then one second protrusion 152, etc. (1:1 ratio). Other exemplary protrusion patterns are illustrated in FIGS. 11-16 and will be discussed in more detail below. The first and second protrusions 150, 152 may also be distributed randomly and not in a specific pattern.

With the exception of the four centermost or unique first protrusions 150A, shown in FIGS. 8A-8D, 9 and 10, which will be specifically discussed below, the remaining, standard first protrusions 150 are identical to one another, and only one of these identical standard first protrusions 150 will be discussed in detail herein. With reference also to FIGS. 8A-8D, the first protrusion 150 extends outwardly in the Z-direction (in the direction of line $L_3$) from a base 160 of the guard structure 18. The base 160 comprises the structure below the first and second protrusions 150 and 152. At least a section of an uppermost portion of the base 160 may be curved in the longitudinal direction and, in the illustrated embodiment, includes floor surface sections 160A between sets of adjacent first and second protrusions 150, 152. A plane $P_{160}$ passes through the highest points in the Z-direction on the uppermost portion of the base 160, i.e., the highest points in the Z-direction on the floor surface sections 160A, see FIGS. 8A-8D, wherein the plane $P_{160}$ is generally perpendicular to the line $L_3$ in FIG. 3 or the Z-direction.

Figure 8:
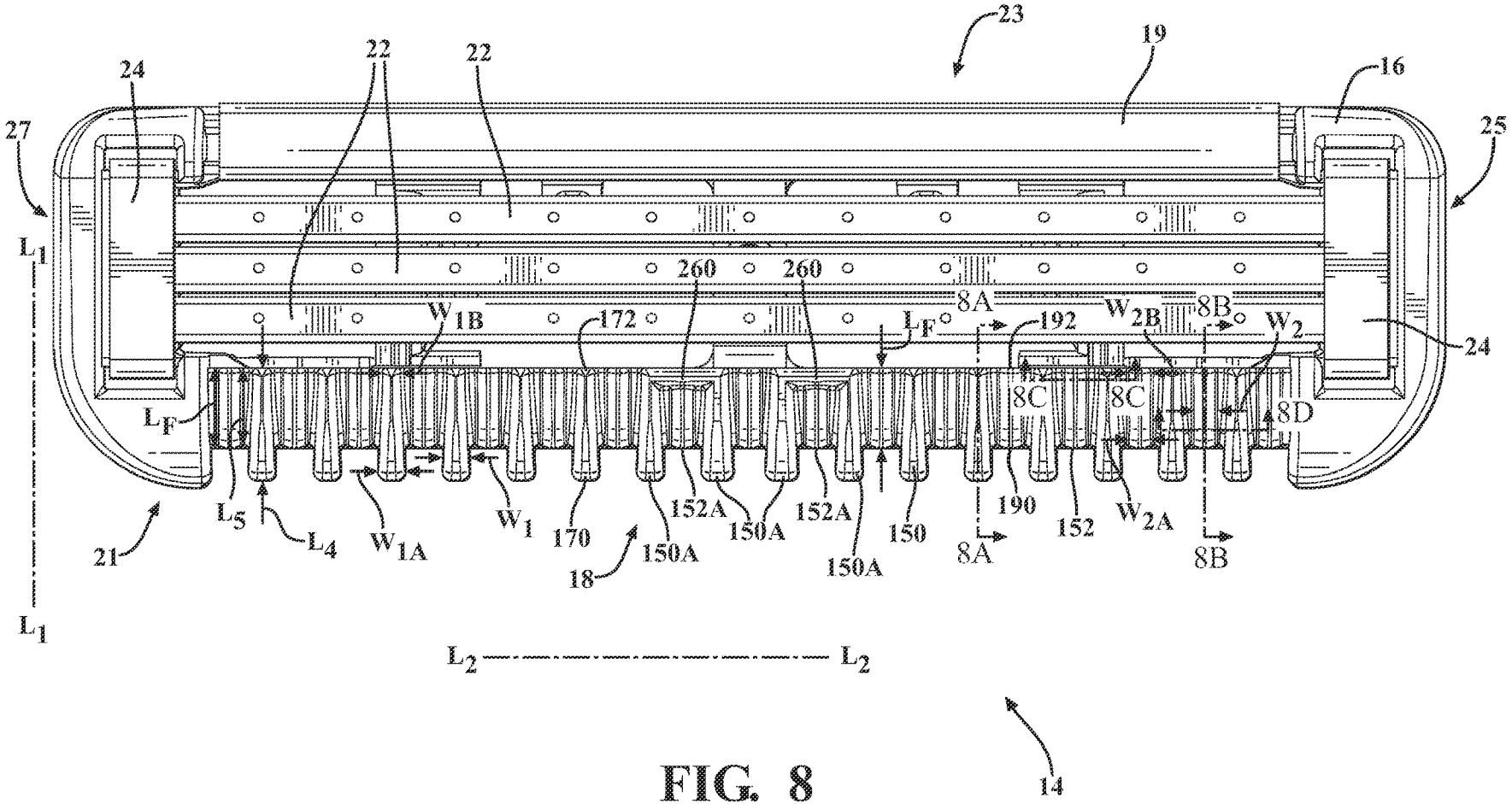
FIG. 8 is a plan view of a top portion of the razor cartridge of FIG. 2.
Figure 8B:
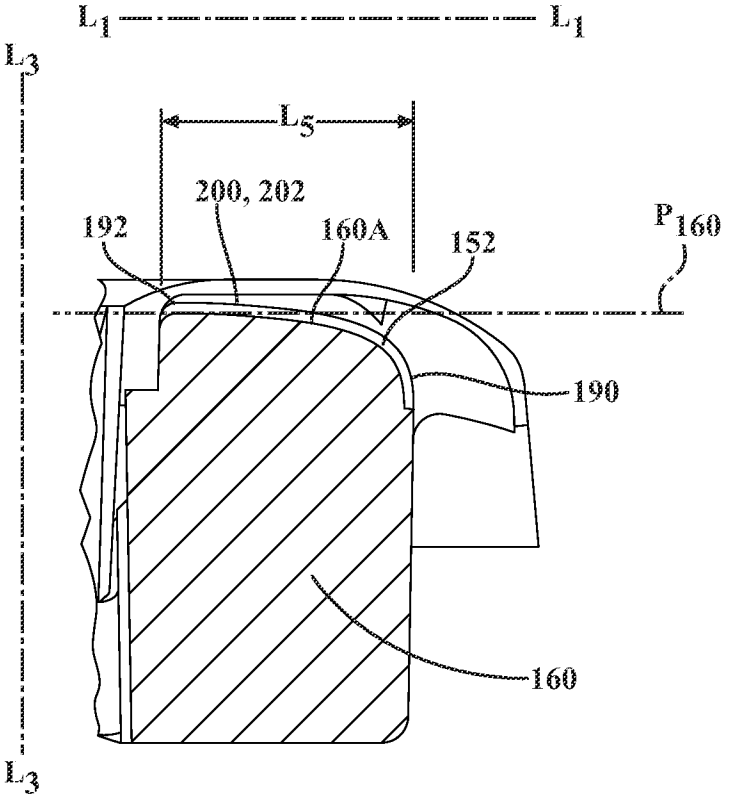
FIGS. 8A-8D are cross sectional views taken through respective lines 8A-8A, 8B-8B, 8C-8C, and 8D-8D in FIG. 8.
Figure 8A:
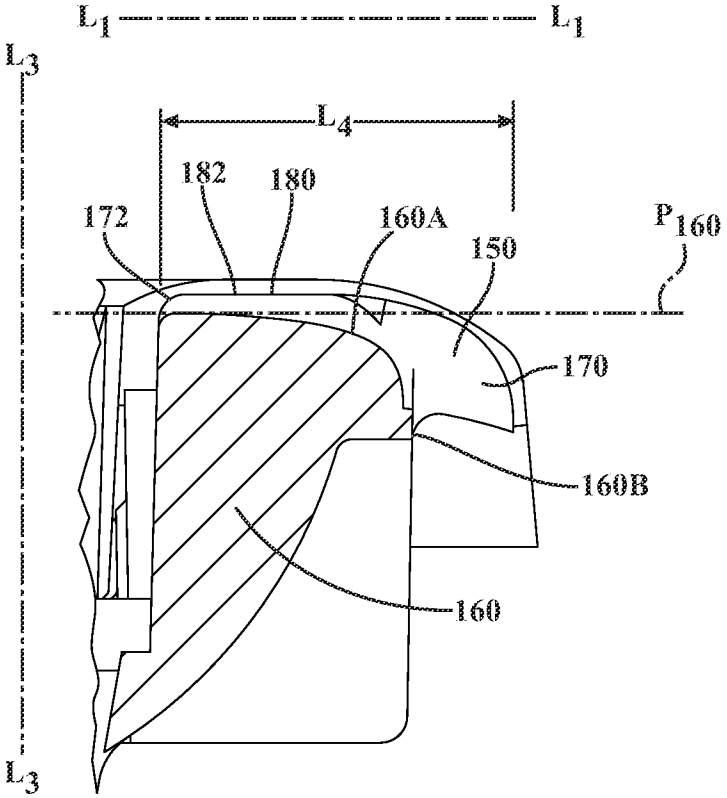

The first protrusion 150 defines a width $W_1$ in the lateral direction (in the direction of line $L_2$) of from about 0.1 mm to about 3.0 mm at a widest point and preferably from about 0.5 mm to about 1.5 mm at the widest point and from about 0.1 mm to about 3.0 mm at a narrowest point and preferably from about 0.1 mm to about 1.0 mm at the narrowest point, see FIG. 8. In the embodiment shown, the widest point of the first protrusion 150 defines a first width $W_{1A}$ located toward a front end 170 of the first protrusion 150, and the narrowest point of the first protrusion 150 defines a second width $W_{1B}$ located toward a back end 172 of the first protrusion 150 adjacent to the blades 22, wherein the front and back ends 170, 172 are spaced apart in the longitudinal direction. As shown most clearly in FIG. 8, the first protrusion 150 optionally tapers from the first width $W_{1A}$ to the second, smaller width $W_{1B}$ as the first protrusion 150 extends in the longitudinal direction toward the back end 172 of the first protrusion 150 and the cartridge back portion 23.

The first protrusion 150 defines a length $L_4$ (see FIGS. 8 and 8A) in a direction of elongation of the first protrusion 150, the direction of elongation being in the longitudinal direction (in the direction of line $L_1$). The length $L_4$ of the first protrusion 150 may be from about 0.1 mm to about 6.0 mm, preferably from about 2.5 mm to about 4.5 mm and most preferably may equal to 3.36 mm. The length $L_4$ may be greater than a length $L_F$ of the base 160 in the longitudinal direction, such that the first protrusion 150 overhangs or extends out from a front edge 160B of the base 160 by at least about 0.3 mm and preferably by at least about 0.75 mm. Most preferably, the first protrusion 150 may overhang or extend out from the front edge of the base 160 by 0.948 mm. One benefit of having a first protrusion 150 that overhangs the base 160 is to provide an early or increase in skin contact with a user's skin prior to reaching the blades 22. The length $L_4$ of the first protrusion 150 may be greater than 6.0 mm The first protrusion 150 defines a height $H_1$ (see FIG. 8C) in the Z-direction (in the direction of line $L_3$), wherein the height $H_1$ is measured from a peak 180 of the first protrusion 150, defined at a highest point (measured in the Z-direction) of a tip 182 of the first protrusion 150, to the plane $P_{160}$ passing through the highest points in the Z-direction on the uppermost portion of the guard structure base 160. The height $H_1$ is greater than zero (0) and may be from about 0.01 mm to about 3.0 mm, preferably from about 0.02 mm to about 1.5 mm, and most preferably may be equal to 0.18 mm. The peak 180 of the first protrusion 150 from which the height $H_1$ is measured may be defined near the back end 172 of the first protrusion 150, see FIGS. 8 and 8A.

Referring to 8C, 8D, and 9, the first protrusion 150 is curved in the lateral direction, giving the first protrusion 150 a lateral curved profile. The first protrusion 150 may be curved starting from a first lateral edge 184 located closer to the first end portion 25 of the cartridge 14, up to the peak 180, and then down to a second lateral edge 186 closer to the second end portion 27 of the cartridge 14, see FIGS. 8C and 8D. The curvature of the first protrusion 150 in the lateral direction defines the lateral curved profile of the first protrusion 150.

With the exception of the two unique second protrusions 152A shown in FIGS. 8-10 that are located between the respective unique pairs of first protrusions 150A, which will be specifically discussed below, the remaining, standard second protrusions 152 are also identical to one another, including the centermost second protrusion 152 located between the innermost unique first protrusions 150A of the two unique pairs of the first protrusions 150A, and only one of these standard second protrusions 152 will be discussed in detail herein. With reference also to FIGS. 8A-8D, the second protrusion 152 extends outwardly in the Z-direction (in the direction of line $L_3$) from the base 160 of the guard structure 18.

The second protrusion 152 defines a width $W_2$ in the lateral direction (in the direction of line $L_2$). The second protrusion 152 may have a generally constant width $W_2$ from a front end 190 of the second protrusion 152 to a back end 192 of the second protrusion 152 adjacent to the blades 22, wherein the front and back ends 190, 192 are spaced in the longitudinal direction. The width $W_2$ of the second protrusion 152 may be from about 0.1 mm to about 3.0 mm, preferably from about 0.4 mm to about 1.0 mm and most preferably may be equal to 0.63 mm. Alternatively, the second protrusion 152 may taper slightly from a first width $W_{2A}$, located toward the second protrusion front end 190, having a value of from about 0.1 mm to about 2.5 mm, to a second, larger width $W_{2B}$, located toward the second protrusion back end 192, having a value of from about 0.15 mm to about 3.0 mm, as the second protrusion 152 extends in the longitudinal direction toward the second protrusion back end 192 and the cartridge back portion 23.

The second protrusion 152 defines a length $L_5$ (see FIGS. 8 and 8B) in a direction of elongation of the second protrusion 152, the direction of elongation being in the longitudinal direction (in the direction of line $L_1$). The length $L_5$ of the second protrusion 152 may be from about 0.1 mm to about 6.0 mm, preferably from about 1.5 mm to about 4.0 mm and most preferably may be equal to 2.38 mm. The length $L_5$ of the second protrusion 152 may be less than the length $L_4$ of the first protrusion 150 and may be substantially equal to the length $L_F$ of the base 160. The length $L_5$ of the second protrusion 152 may also be greater than 6.0 mm.

The second protrusion 152 defines a height $H_2$ (see FIG. 8C) in the Z-direction (in the direction of line $L_3$), wherein the height $H_2$ is measured from a peak 200 of the second protrusion 152, defined at a highest point (measured in the Z-direction) of a tip 202 of the second protrusion 152, to the plane $P_{160}$ passing through the highest points in the Z-direction on the uppermost portion of the guard structure base 160. The height $H_2$ is greater than zero (0) and may be at least from about 0.01 mm to about 3.0 mm, and preferably may be at least from about 0.02 mm to about 1.0 mm and most preferably may be equal to 0.1 mm. The peak 200 of the second protrusion 152 from which the height $H_2$ is measured may be defined near the second protrusion back end 192, see FIGS. 8A and 8B. As shown in FIG. 8C, the height $H_1$ of the first protrusion 150 from the plane $P_{160}$ passing through the highest points in the Z-direction on the uppermost portion of the base 160 is greater than the height $H_2$ of the second protrusion 152 from the plane $P_{160}$ passing through the highest points in the Z-direction on the uppermost portion of the base 160. The difference between the first and second heights $H_1$, $H_2$ may be from about 0.05 mm to about 1.0 mm and preferably may be equal to 0.08 mm.

Referring to 8C, 8D, and 9, the second protrusion 152 is curved in the lateral direction, giving the second protrusion 152 a lateral curved profile. The second protrusion 152 may be curved starting from a first lateral edge 204 located closer to the first end portion 25 of the cartridge 14, up to the peak 200, and then down to a second lateral edge 206 closer to the second end portion 27 of the cartridge 14, see FIGS. 8C and 8D. The curvature of the second protrusion 152 in the lateral direction defines the lateral curved profile of the second protrusion 152. The curved profiles of the first and second protrusions 150, 152 are different from one another, as can be seen in FIGS. 8C and 8D.

Figure 8D:
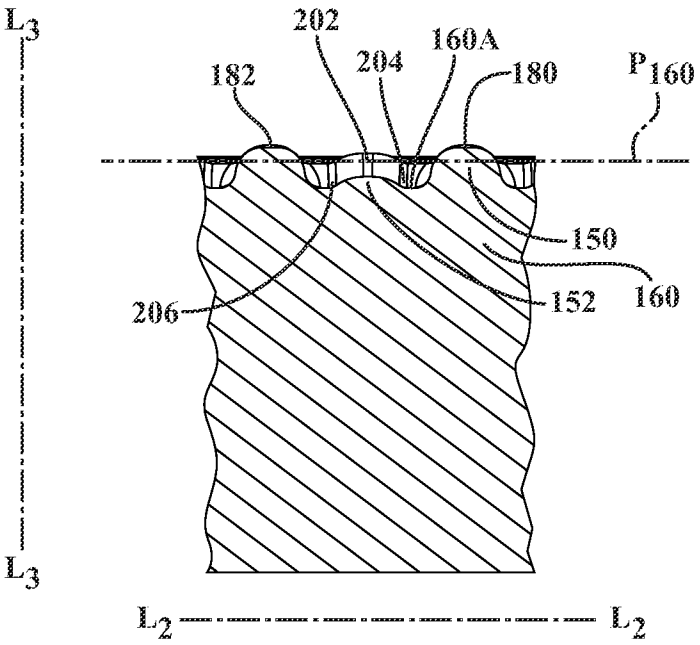
Figure 8C:
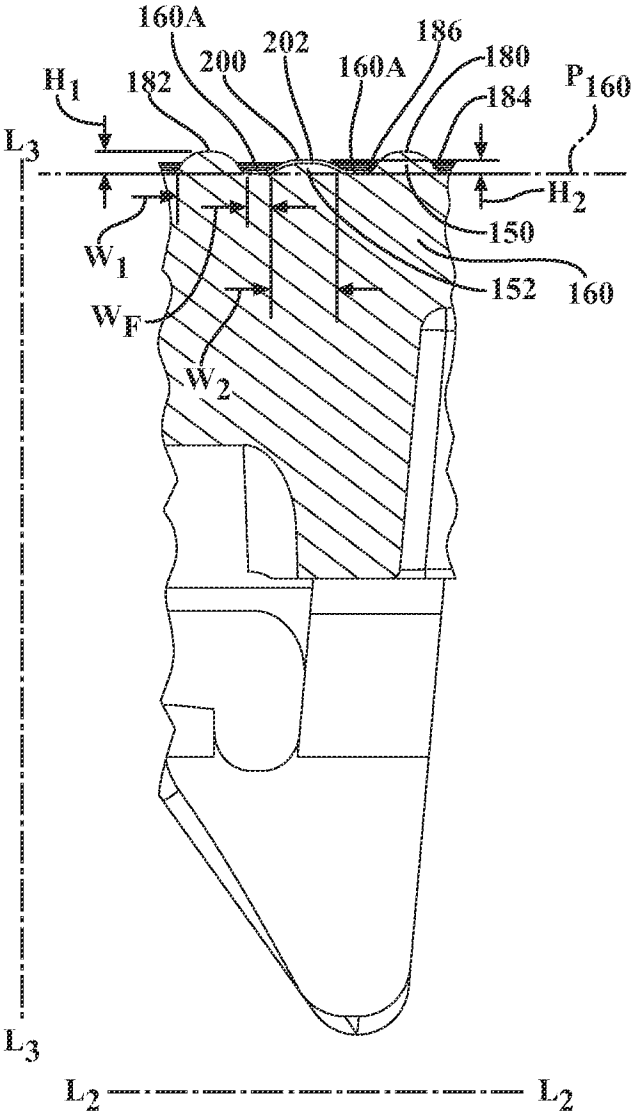

In the illustrated embodiment, there is a small gap between adjacent first and second protrusions 150, 152 defining the floor surface section 160A between each set of adjacent first and second protrusions 150, 152, see FIGS. 8C and 8D. The floor surface sections 160A may have a width $W_F$ up to about 3.0 mm and preferably from about 0.1 mm to about 0.5 mm, as measured in the lateral direction. The floor surface sections 160A are generally located within the uppermost portion of the base 160 and may have at least a section curved in the longitudinal direction. The floor surface section width $W_F$ may be less than the widths $W_1$, $W_2$ of the first and second protrusions 150, 152, see FIG. 8C. Due to the optional tapering of the first protrusions 150 and/or the second protrusions 152, the width $W_F$ of the floor surface sections 160A correspondingly tapers from a lesser width toward the cartridge front portion 21 to a greater width toward the blades 22. It is noted that first and second protrusions 150, 152 may directly engage such that there is little or no gap between the adjacent first and second protrusions 150, 152. Hence, there may not be a floor surface section between adjacent first and second protrusions 150, 152.

As noted above, the guard structure 18 comprises unique first protrusions 150A and unique second protrusions 152A. One or more of the unique first protrusions 150A may have greater dimensions (e.g., width) than the remaining or standard first protrusions 150 discussed above. Such unique first protrusion(s) 150A having larger dimensions, as well as spanning members 260 that span between pairs of the unique first protrusions 150A (see FIG. 8), may be used as reference features for an online inspection system (not shown). The spanning members 260 result in the unique second protrusions 152A being shorter in length (in the longitudinal direction) than the remaining standard second protrusions 152. It is noted that these unique first and second protrusions 150A, 152A are optional, as the standard first and second protrusions 150, 152 as set out above could be used in the place of the unique protrusions 150A, 152A. The unique first protrusion 150A may define a width in the lateral direction (in the direction of line $L_2$) of from about 0.1 mm to about 3.0 mm at a widest point and preferably from about 0.5 mm to about 2.0 mm at the widest point and from about 0.1 mm to about 3.0 mm at a narrowest point and preferably from about 0.1 mm to about 1.5 mm at the narrowest point. The length of the unique second protrusion 152A may be from about 0.1 mm to about 6.0 mm, preferably from about 1.5 mm to about 4.0 mm and most preferably may be equal to 1.85 mm. While specific and generally preferred values are given above for various dimensions of the guard structure components, these values can vary by up to about +/−0.5 mm as contemplated by the present invention.

Figure 9:
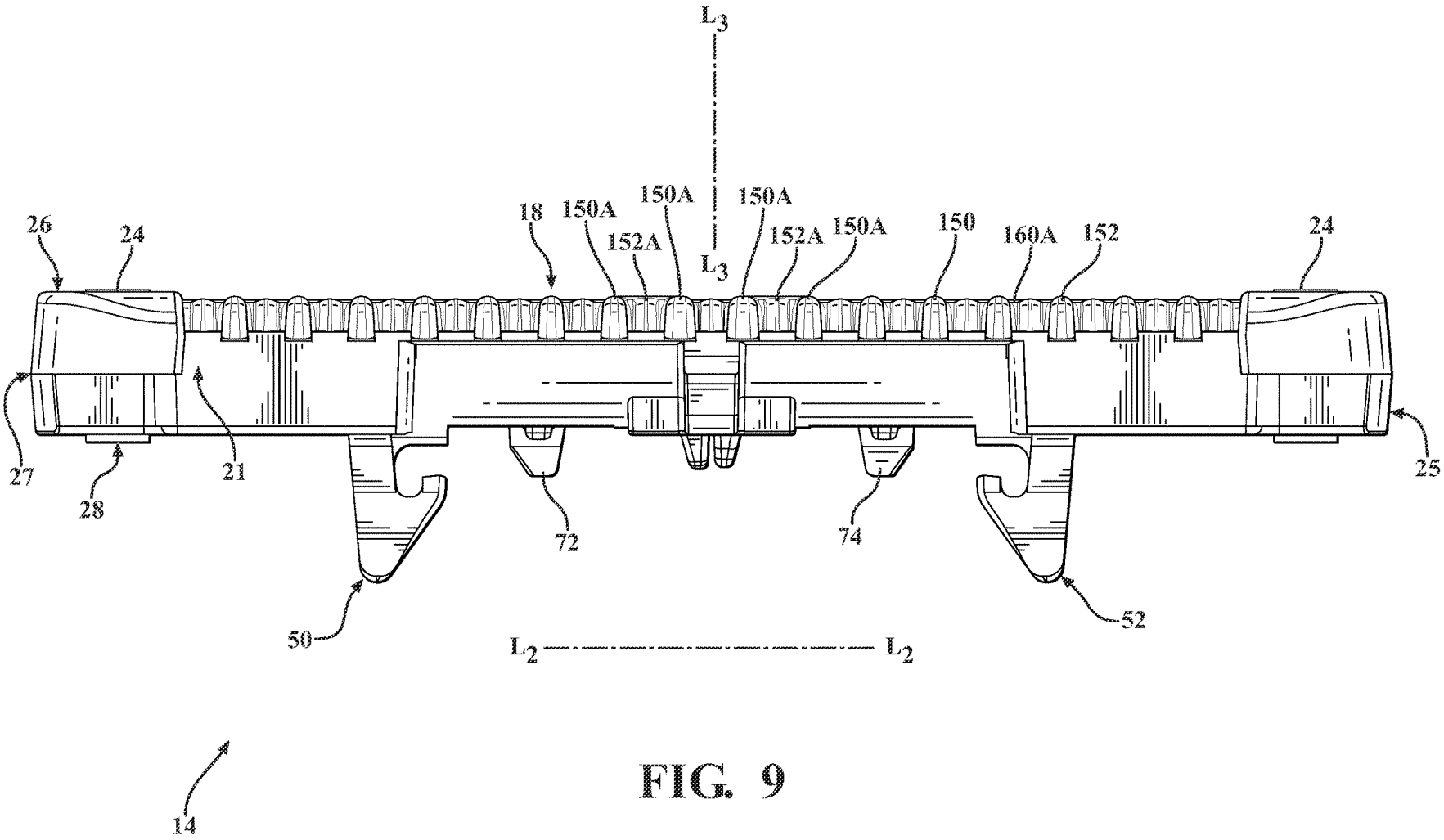
FIG. 9 is a plan view of a front portion of the razor cartridge of FIG. 2.
Figure 10:
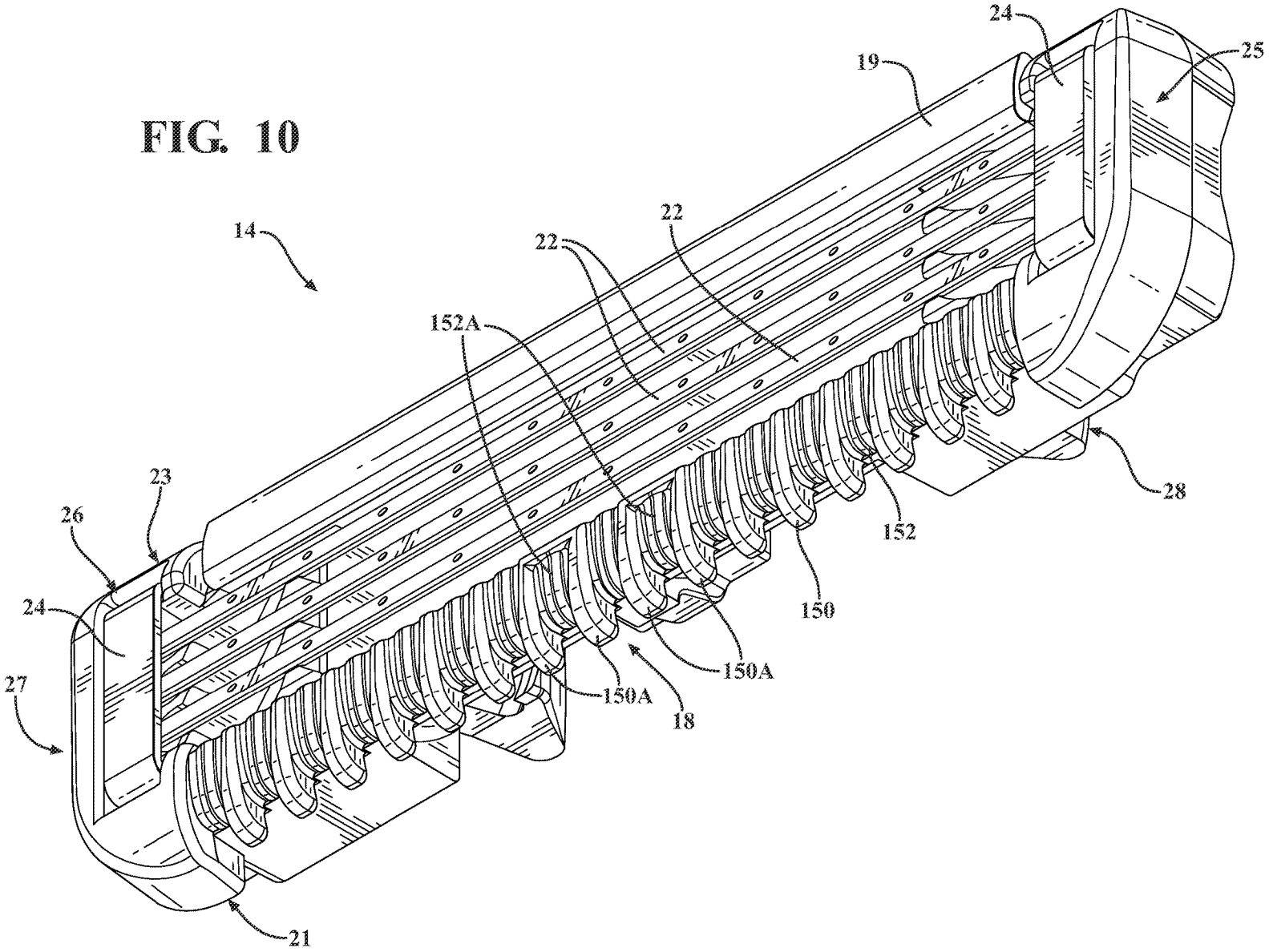
FIG. 10 is a perspective view of a razor cartridge of the razor cartridge of FIG. 2, as seen from the top and front sides.
Figure 11:
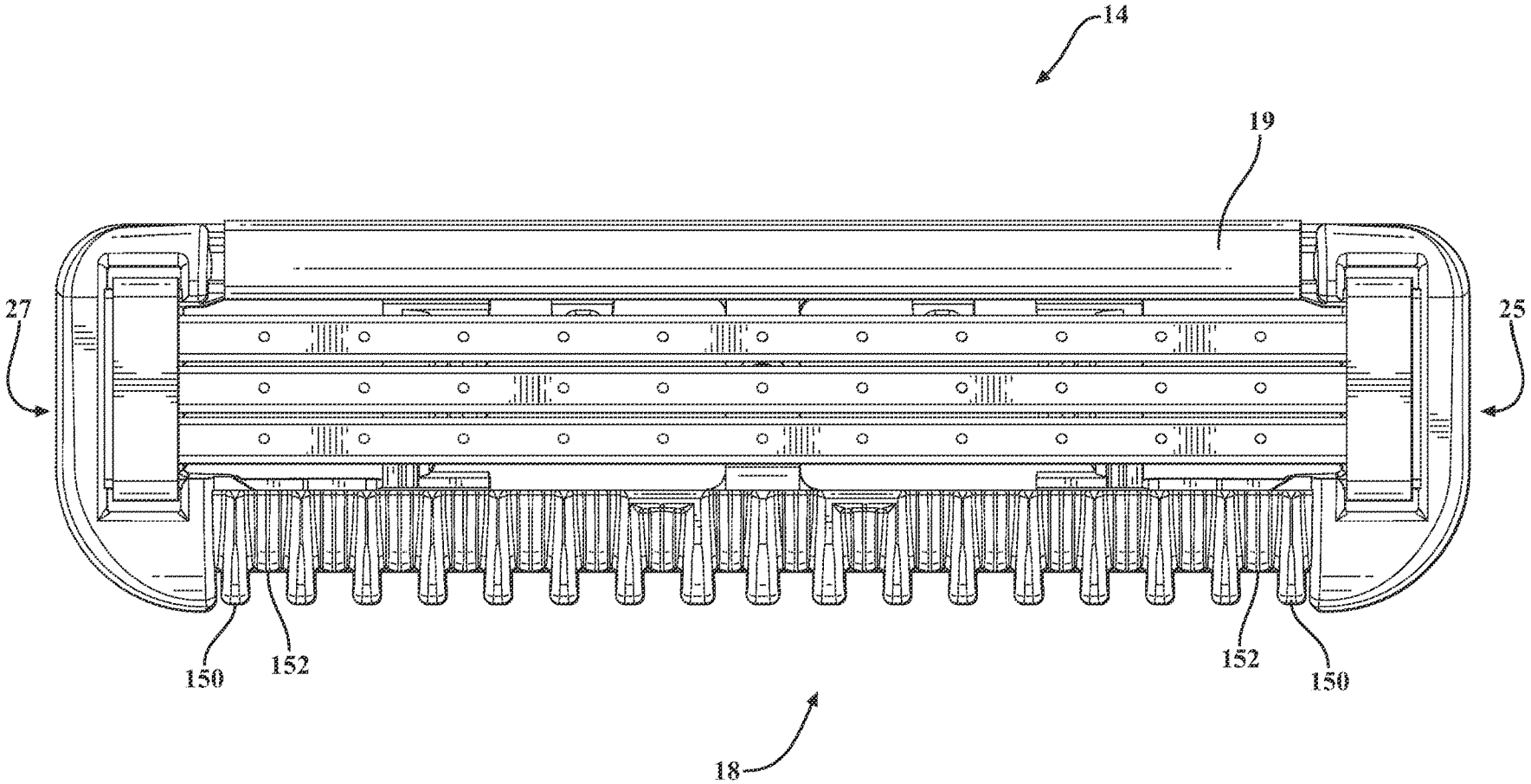
FIG. 11 is a plan view of a top portion of a razor cartridge in accordance with the present disclosure.
Figure 12:
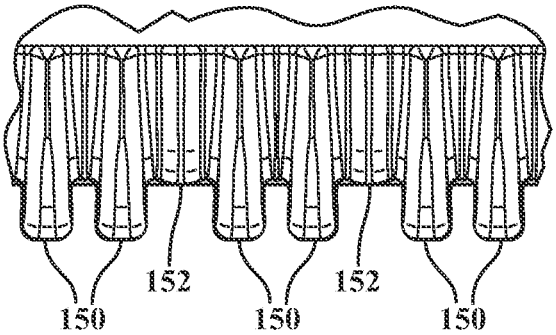
FIGS. 12-14 are plan views of exemplary protrusion patterns in accordance with the present disclosure.
Figure 13:
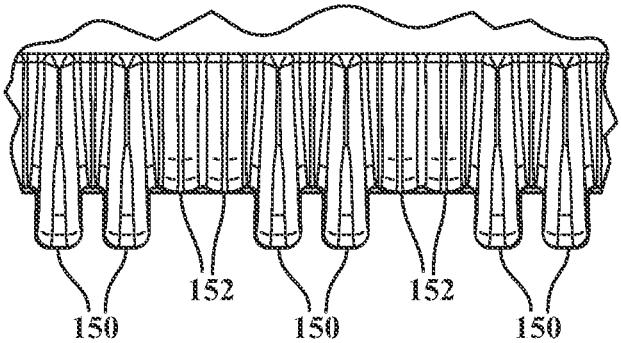
Figure 14:
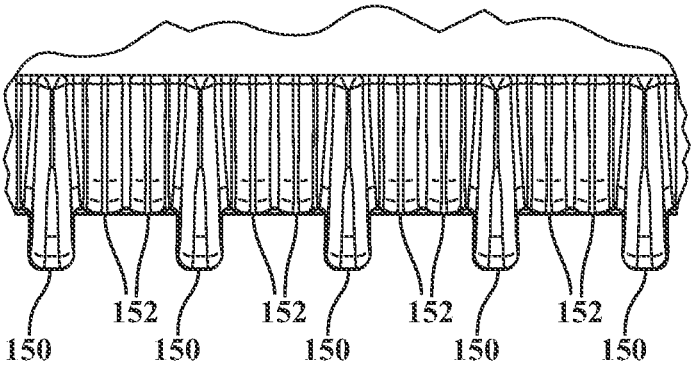

The guard structure 18 shown in FIGS. 8-10 includes a pattern of alternating first and second protrusions 150, 152, wherein a first and a last protrusion, i.e., located at opposing ends of the guard structure 18 adjacent to the respective cartridge first and second end portions 25, 27, comprise second protrusions 152. FIG. 11 shows an alternate configuration of the guard structure 18, wherein the first and last protrusions are first protrusions 150.

In accordance with exemplary embodiments of the present disclosure, the number of first protrusions 150 (including the unique first protrusions 150A) can be equal to "X", and the number of second protrusions 152 (including the unique second protrusions 152A) can be "Y", wherein X may be equal to Y, or X may be equal to (Y+/−1). For example, in FIGS. 8-10, X=16 and Y=17, and in FIG. 11, X=17 and Y=16. It is noted that these values of X and Y are exemplary and X and Y could be any desired number.

Moreover, other guard structure patterns are also contemplated, such as exemplary configurations wherein:

1. Pairs of first protrusions 150 are positioned between respective individual second protrusions 152, e.g., left and right second protrusions 152 may be positioned on opposite sides of a pair of the first protrusions 150, see FIG. 12;

2. Pairs of first protrusions 150 are positioned between pairs of second protrusions 152, see FIG. 13; and 3. Pairs of second protrusions 152 are positioned between respective individual first protrusions 150, e.g., left and right first protrusions 150 may be positioned on opposite sides of a pair of the second protrusions 152, see FIG. 14.

Any number of alternate protrusion patterns, or a random configuration of first and second protrusions, could also be used in accordance with the present disclosure.

Figure 15:
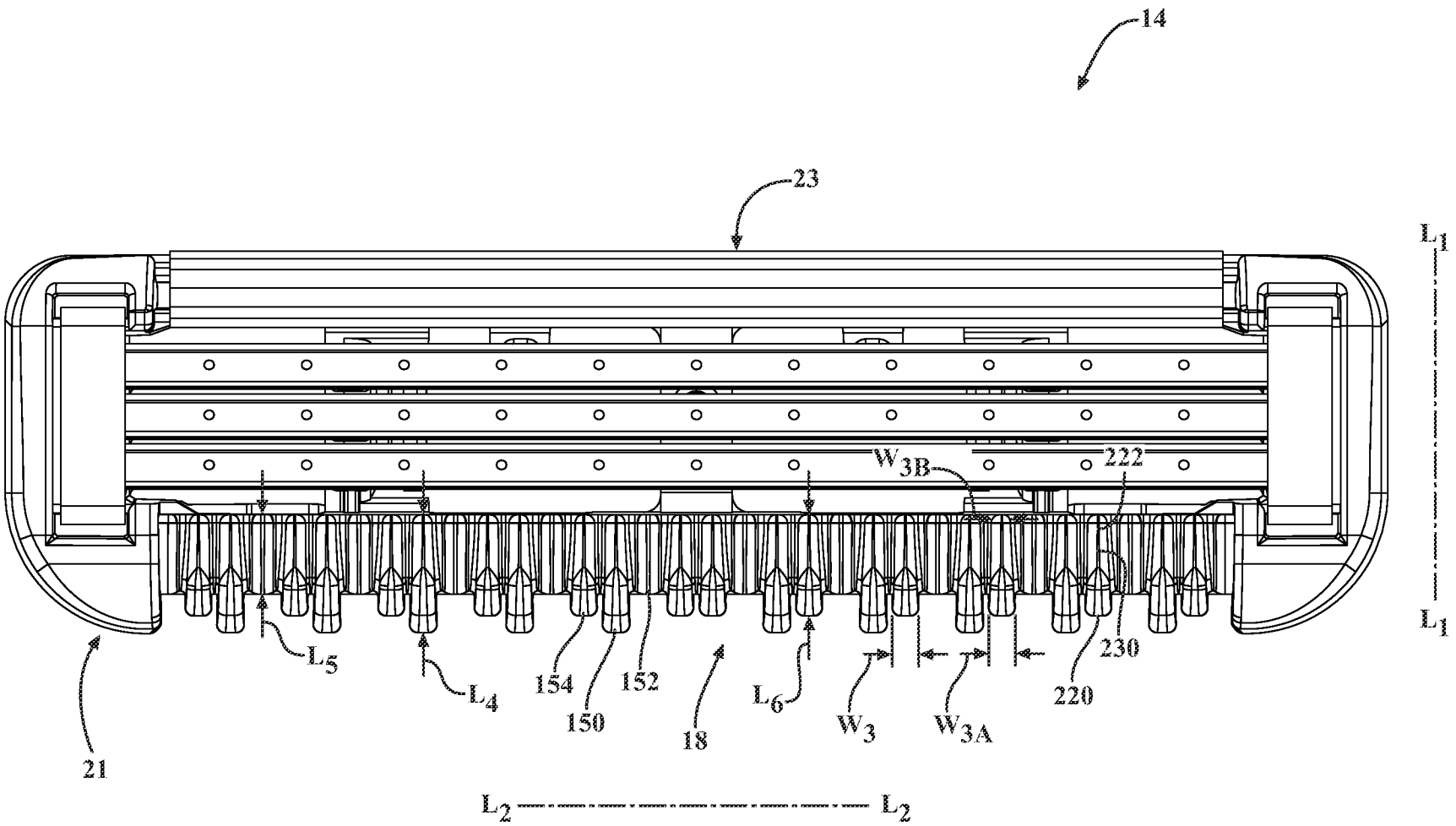
FIGS. 15 and 16 are views of an alternate protrusion configuration in accordance with the present disclosure.
Figure 16:
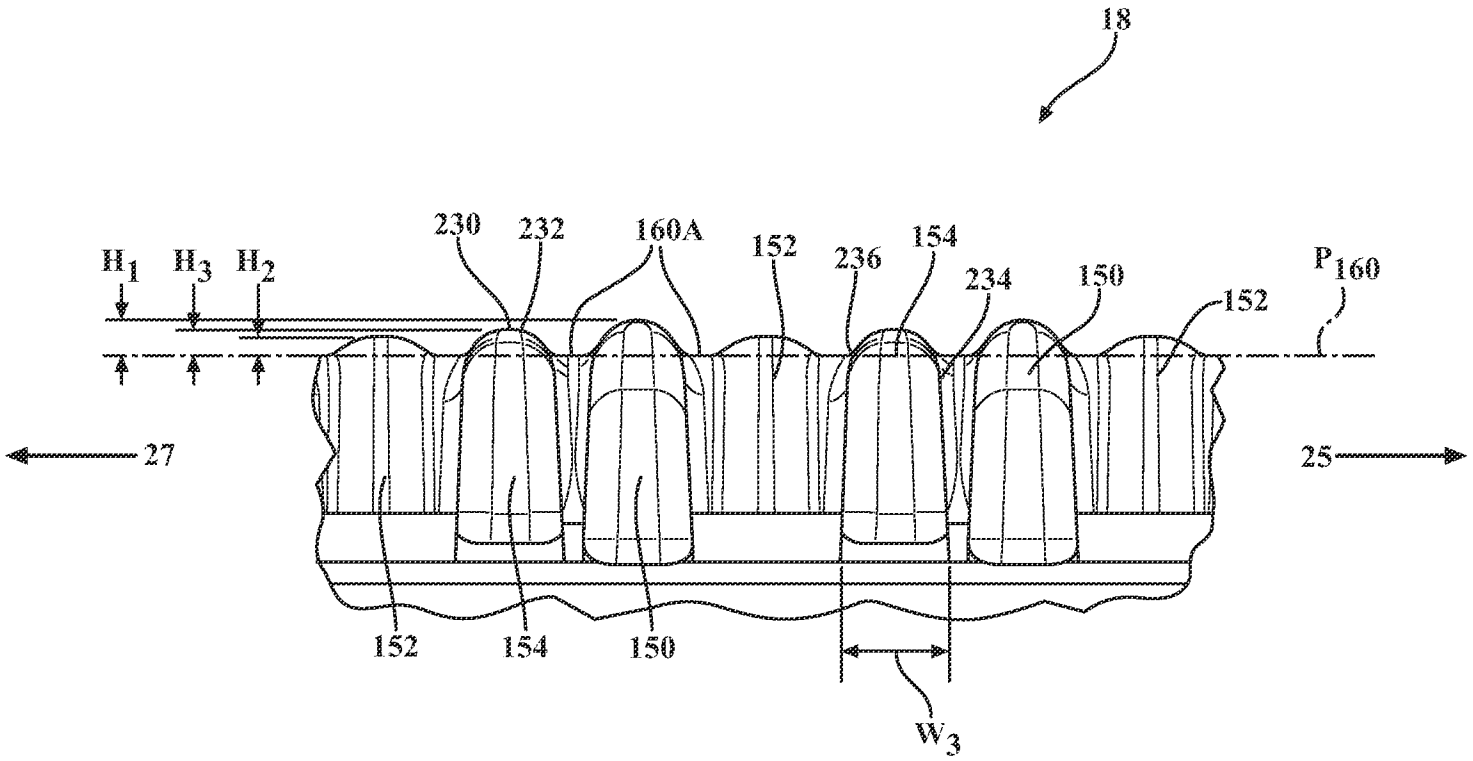

Further, while FIGS. 1-14 illustrate first and second protrusions 150, 152, additional protrusions having other shapes/sizes may be included in the guard structure 18. For example, FIGS. 15 and 16 illustrate a guard structure 18 that includes the first and second protrusions 150, 152 described above as well as a plurality of third protrusions 154. In the illustrated embodiment, the third protrusions 154 have dimensions that are different from those of the first and second protrusions 150, 152.

One of the third protrusions 154 will now be described with reference to FIGS. 15 and 16. Structure identified in FIGS. 1-14, discussed above and also shown in FIGS. 15 and 16 will include the same reference number in FIGS. 15 and 16 that was used in FIGS. 1-14 and will not be specifically described with respect to FIGS. 15 and 16.

The third protrusion 154 extends outwardly in the Z-direction (in the direction of line $L_3$) from the base 160 of the guard structure 18.

The third protrusion 154 defines a width $W_3$ in the lateral direction (in the direction of line $L_2$) of about 0.1 mm to about 3.0 mm at a widest point and preferably from about 0.5 mm to about 1.5 mm at the widest point and from about 0.1 mm to about 3.0 mm at a narrowest point and preferably from about 0.1 mm to about 1.0 mm at the narrowest point, see FIG. 15. In the embodiment shown, the widest point of the third protrusion 154 defines a first width $W_{3A}$ located toward a front end 220 of the third protrusion 154, and the narrowest point of the third protrusion 154 defines a second width $W_{3B}$ located toward a back end 222 of the third protrusion 154 adjacent to the blades 22, wherein the front and back ends 220, 222 are spaced apart in the longitudinal direction. The third protrusion 154 optionally tapers from the first width $W_{3A}$ to the second, smaller width $W_{3B}$ as the third protrusion 154 extends in the longitudinal direction toward the back end 222 of the third protrusion 154 and the cartridge back portion 23.

The third protrusion 154 defines a length $L_6$ (see FIG. 15) in a direction of elongation of the third protrusion 154, the direction of elongation being in the longitudinal direction (in the direction of line $L_1$). The length $L_6$ of the third protrusion 154 may be from about 0.1 mm to about 6.0 mm, preferably from about 2.0 mm to about 4.0 mm and most preferably may be equal to 3.031 mm. The length $L_6$ of the third protrusion 154 may be greater than the length $L_F$ of the base 160 of the guard structure 18 in the longitudinal direction, such that the third protrusion 154 overhangs the front edge of the base 160 by at least 0.2 mm, and preferably by at least about 0.5 mm. Most preferably, the third protrusion 154 may overhang or extend out from the front edge of the base 160 by 0.643 mm. As shown in FIG. 15, the length $L_6$ of the third protrusion 154 is intermediate the lengths $L_4$, $L_5$ of the first and second protrusions 150, 152. The length $L_6$ of the third protrusion 154 may be greater than 6.0 mm.

The third protrusion 154 defines a height $H_3$ (see FIG. 16) in the Z-direction (in the direction of line $L_3$), wherein the height $H_3$ is measured from a peak 230 of the third protrusion 154, defined at a highest point (measured in the Z-direction) of a tip 232 of the third protrusion 154, to the plane $P_{160}$ passing through the highest points in the Z-direction on the uppermost portion of the guard structure base 160. The height $H_3$ is greater than zero (0), is intermediate the heights $H_1$, $H_2$ of the first and second protrusions 150, 152 (see FIG. 16), and may be from about 0.1 mm to about 3.0 mm, preferably from about 0.05 mm to about 1.25 mm and most preferably is equal to 0.14 mm. The peak 230 of the third protrusion 154 from which the height $H_3$ is measured may be defined near the back end 222 of the third protrusion 154, see FIG. 15. In the FIG. 16 embodiment, the height $H_1$ of each first protrusion 150 is greater than zero (0) and may be from about 0.01 mm to about 3.0 mm, preferably from about 0.02 mm to about 1.5 mm, and most preferably may be equal to 0.18 mm. Also, in the FIG. 16 embodiment, the height $H_2$ of each second protrusion 152 is greater than zero (0) and may be at least from about 0.01 mm to about 3.0 mm, and preferably may be at least from about 0.02 mm to about 1.0 mm and most preferably may be equal to 0.1 mm.

The third protrusion 154 is curved in the lateral direction, giving the third protrusion 154 a curved profile. The third protrusion 154 may be curved starting from a first lateral edge 234 located closer to the first end portion 25 of the cartridge 14, up to the peak 230, and then down to a second lateral edge 236 closer to the second end portion 27 of the cartridge 14, see FIG. 16. The curvature of the third protrusion 154 defines the curved profile of the third protrusion 154. The curved profiles of the first, second, and third protrusions 150, 152, 154 may be different from one another, as can be seen in FIG. 16.

While the heights $H_1$, $H_2$ and $H_3$ of the first, second and third protrusions 150, 152 and 154 are measured relative to the plane $P_{160}$ passing through the highest points in the Z-direction on the uppermost portion of the guard structure base 160, it is contemplated that the heights $H_1$, $H_2$ and $H_3$ of the first, second and third protrusions 150, 152 and 154 may be measured relative to any other portion of the guard structure base 160.

It is noted that in each of the embodiments of FIGS. 8-16, one or more of the first protrusions 150 are positioned between at least one set of adjacent ones of the second protrusions 152.

The guard structure 18 described herein, including the protrusion configurations and dimensions described above may generally allow for an improved shave performance over traditional guard structures of a single material housing. For example, the protrusions of the present disclosure are believed to stimulate, flatten, stretch, and/or engage the skin in front of the blades 22, tending to improve comfort and proper positioning of the skin for cutting of hairs. Moreover, the rounded profiles of the protrusions provide a robust structure as the first skin contacting member just before engagement by the first blade 22, to improve skin management and improve comfort.

Additionally, a benefit of having protrusions of varying heights is that shave material, e.g., shaving aid material and/or shave prep material, may be captured in the areas between the protrusions with the greatest heights, e.g., between adjacent first protrusions 150 in the embodiments of FIGS. 1-16. This is particularly true toward the front end 21 of the razor cartridge 14 where the difference in height between the first and second protrusions 150, 152 is the greatest, see FIGS. 8C and 8D. The capturing of such shave material between the protrusions may provide a more uniform distribution of the material on a user's skin, which alleviates discomfort by continuing to lubricate hair. Theoretically, such a protrusion configuration may leave behind or allow some shave material to be reapplied in subsequent strokes after a user has initially applied it on their skin, rather than being completely wiped off by the guard.

While the protrusion configurations disclosed herein have been described in a guard structure 18 in front of the blades 22 toward the front portion 21 of the cartridge 14, the protrusion configurations of the present disclosure could also or alternatively be used in the cap structure 19 toward the back portion 23 of the cartridge 14.

Combinations

Representative embodiments of the present disclosure described above can be described as follows:

A. A cartridge for a razor comprising a housing comprising:
- first and second opposed end portions spaced apart in a lateral direction of the cartridge, which lateral direction is parallel to one or more blades provided in the housing;
- front and back portions spaced apart in a longitudinal direction of the cartridge;
- a structure defining at least one of the front portion or the back portion comprising:
  - a plurality of first protrusions extending from a base of the structure, the first protrusions having a direction of elongation in a longitudinal direction, each of the first protrusions defining:
    - a width in the lateral direction;
    - a length in the longitudinal direction;
    - a height in a Z-direction, wherein the Z-direction is perpendicular to both the lateral and longitudinal directions; and
    - a peak at a highest point of a tip of the protrusion as measured in the Z-direction, the peak located at a first distance greater than zero from the base of the structure;
  - a plurality of second protrusions extending from the base of the structure, the second protrusions having a direction of elongation in the longitudinal direction, each of the second protrusions defining:
    - a width in the lateral direction;
    - a length in the longitudinal direction;
    - a height in the Z-direction; and
    - a peak at a highest point of a tip of the protrusion as measured in the Z-direction, the peak located at a second distance greater than zero from the base of the structure, wherein the first distance is greater than the second distance such that the heights of the plurality of first protrusions are greater than the heights of the plurality of second protrusions;
  - wherein one or more of the first protrusions are positioned between at least one set of adjacent ones of the second protrusions.

B. The cartridge as set out in paragraph A, wherein the length of the first protrusions is greater than a length of the base in the longitudinal direction.

C. The cartridge as set out in any of paragraphs A-B, wherein the length of the second protrusions is substantially equal to a length of the base in the longitudinal direction.

D. The cartridge as set out in any of paragraphs A-C, wherein the length of the first protrusions is greater than the length of the second protrusions.

E. The cartridge as set out in any of paragraphs A-D, wherein the height of the first protrusions in the Z-direction from a highest point on the base is from about 0.1 mm to about 3.0 mm and the height of the second protrusions in the Z-direction from the highest point on the base is from about 0.1 mm to about 3.0 mm.

F. The cartridge as set out in any of paragraphs A-E, wherein the height of the first protrusions from the highest point on the base is at least about 0.08 mm greater than the height of the second protrusions from the highest point on the base.

G. The cartridge as set out in any of paragraphs A-F, wherein the base comprises floor surface sections between adjacent ones of the first and second protrusions, each of the floor surface sections has a width in the lateral direction which is less than the width of any one of the first or second protrusions.

H. The cartridge as set out in any of paragraphs A-G, wherein each of the floor surface sections has a width between each pair of adjacent ones of the first and second protrusions of from about 0.1 mm to about 0.5 mm.

I. The cartridge as set out in any of paragraphs A-H, wherein the structure comprises a guard structure located in front of the one or more blades that extend in the lateral direction.

J. The cartridge as set out in any of paragraphs A-I, wherein the first protrusions taper from a first width in the lateral direction to a second, smaller width in the lateral direction as the protrusions extend in the longitudinal direction toward the cartridge back portion.

K. The cartridge as set out in any of paragraph A-J, wherein the second protrusions are shaped to:

taper from a first width in the lateral direction to a second, larger width in the lateral direction as the protrusions extend in the longitudinal direction toward the cartridge back portion; or have a substantially constant width in the lateral direction from front ends of the second protrusions located toward the cartridge front portion to back ends of the second protrusions spaced in the longitudinal direction from the front ends of the second protrusions.

L. The cartridge as set out in any of paragraphs A-K, wherein the first and second protrusions are curved in the lateral direction, and wherein the curved profiles of the first and second protrusions are different from one another.

M. The cartridge as set out in any of paragraphs A-L, wherein the structure comprises X number of first protrusions and Y number of second protrusions, and wherein X=Y; or X=(Y+/−1).

N. The cartridge as set out in any of paragraphs A-M, wherein the structure comprises a first and a last protrusion comprising ones of the first protrusions.

O. The cartridge as set out in any of paragraphs A-N, wherein the structure comprises a first and a last protrusion comprising ones of the second protrusions.

P. The cartridge as set out in any of paragraphs A-O, wherein the first and second protrusions are arranged in a pattern.

Q. The cartridge as set out in paragraph P, wherein the pattern comprises alternating first and second protrusions.

R. The cartridge as set out in paragraph P, wherein the pattern comprises pairs of the first protrusions alternating with pairs of the second protrusions.

S. The cartridge as set out in paragraph P, wherein the pattern comprises one of either the first or the second protrusions alternating with pairs of the other of the first or the second protrusions.

T. The cartridge as set out in paragraph P, wherein the structure further comprises a plurality of third protrusions having at least one of a width, length or height different from a corresponding width, length or height of each of the first and second protrusions, wherein the pattern comprises alternating first, second and third protrusions.

U. The cartridge as set out in any of paragraphs A-P, wherein the structure further comprises a plurality of third protrusions extending from the base of the structure, the third protrusions having a direction of elongation in the longitudinal direction, each of the third protrusions defining:

a width in the lateral direction;

a length in the longitudinal direction;

a height in the Z-direction; and a peak at a highest point of a tip of the protrusion as measured in the Z-direction;

wherein at least one of the width, length, or height of the third protrusions is different than the corresponding width, length, or height of the first protrusions, and at least one of the width, length, or height of the third protrusions is different than the corresponding width, length, or height of the second protrusions.

V. A cartridge for a razor comprising a housing comprising:

first and second opposed end portions spaced apart in a lateral direction of the cartridge, which lateral direction is parallel to one or more blades provided in the housing;

front and back portions spaced apart in a longitudinal direction of the cartridge;

a structure defining at least one of the front portion or the back portion comprising:

a plurality of first protrusions extending from a base of the structure, the first protrusions having a direction of elongation and a first length in the longitudinal direction, a first width in a lateral direction and a first height in a Z-direction, wherein the Z-direction is perpendicular to both the lateral and longitudinal directions; and a plurality of second protrusions extending from the base of the structure, the second protrusions having a direction of elongation and a second length in the longitudinal direction, a second width in the lateral direction and a second height in the Z-direction, wherein the second length is less than the first length;

wherein one or more of the first protrusions are positioned between at least one set of adjacent ones of the second protrusions.

W. The cartridge as set out in paragraph V, wherein the first and second protrusions are arranged in a pattern.

X. The cartridge as set out in paragraph W, wherein the pattern comprises alternating first and second protrusions.

Y. The cartridge as set out in paragraph W, wherein the pattern comprises pairs of the first protrusions alternating with pairs of the second protrusions.

Z. The cartridge as set out in paragraph W, wherein the pattern comprises one of either the first or the second protrusions alternating with pairs of the other of the first or the second protrusions.

AA. The cartridge as set out in paragraph W, wherein the structure further comprises a plurality of third protrusions have one of a width, length or height different from a corresponding width, length or height of each of the first and second protrusions, wherein the pattern comprises alternating first, second and third protrusions.

BB. The cartridge as set out in any of paragraphs V-Z and AA, wherein the structure comprises a first and a last protrusion comprising ones of the first protrusions.

CC. The cartridge as set out in any of paragraphs V-Z and AA-BB, wherein the structure comprises a first and a last protrusion comprising ones of the second protrusions.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cartridge for a razor comprising a housing comprising:

first and second opposed end portions spaced apart in a lateral direction of the cartridge;

front and back portions spaced apart in a longitudinal direction of the cartridge, the longitudinal direction being perpendicular to the lateral direction; and a structure defining the front portion of the housing, the structure comprising:

a base;

a plurality of first protrusions, each of the first protrusions having an elongated length defined in the longitudinal direction such that each of the first protrusions extend outwardly from the base of the structure, each of the first protrusions defining:

a width in the lateral direction; and a first height in a Z-direction, wherein the Z-direction is perpendicular to both the lateral and longitudinal directions, the first height being measured between a peak at a highest point of a tip of the protrusion as measured in the Z-direction and a plane of the base parallel to the longitudinal direction and defined by an outermost portion of the base;

a plurality of second protrusions, each of the second protrusions having an elongated length in the longitudinal direction such that each of the second protrusions extend outwardly from the base of the structure, each of the second protrusions defining:

a width in the lateral direction; and a second height in the Z-direction, the second height being measured between a peak at a highest point of a tip of the protrusion as measured in the Z-direction and the plane of the base, the second height being greater than zero, wherein the first height is greater than the second height;

wherein the first and second protrusions are arranged such that the first protrusions alternate with the second protrusions in the lateral direction.

2. The cartridge as set out in claim 1, wherein the length of the first protrusions is greater than a length of the base in the longitudinal direction.

3. The cartridge as set out in claim 1, wherein the length of the second protrusions is substantially equal to a length of the base in the longitudinal direction.

4. The cartridge as set out in claim 1, wherein the length of the first protrusions is greater than the length of the second protrusions.

5. The cartridge as set out in claim 1, wherein the first height of the first protrusions is from about 0.1 mm to about 3.0 mm and the second height of the second protrusions is from about 0.02 mm to about 1.0 mm.

6. The cartridge as set out in claim 1, wherein the first height of the first protrusions is at least about 0.08 mm greater than the second height of the second protrusions.

7. The cartridge as set out in claim 1, wherein the base comprises floor surface sections between adjacent ones of the first and second protrusions, each of the floor surface sections has a width in the lateral direction which is less than the width of any one of the first or second protrusions.

8. The cartridge as set out in claim 7, wherein the width of each of the floor surface sections is from about 0.1 mm to about 0.5 mm.

9. The cartridge as set out in claim 1, wherein the cartridge further comprises blades elongated in the lateral direction and wherein the structure defines a guard structure located in front of the one or more blades.

10. The cartridge as set out in claim 1, wherein the width of the first protrusions decreases from a first dimension to a second, smaller dimension along the elongated length of the first protrusions toward the back portion of the housing.

11. The cartridge as set out in claim 10, wherein the width of the second protrusions either:

increases from a first dimension to a second, larger dimension along the elongated length of the second protrusions toward the back portion of the housing; or is substantially constant from front ends of the second protrusions located toward the front portion of the housing to back ends of the second protrusions spaced in the longitudinal direction from the front ends of the second protrusions.

12. The cartridge as set out in claim 1, wherein the first and second protrusions are curved in the lateral direction to define a first curved profile and a second curved profile, respectively, and wherein the first and second curved profiles of the first and second protrusions are different from one another.

13. The cartridge as set out in claim 1, wherein the structure comprises X number of the first protrusions and Y number of the second protrusions, and wherein X=Y; or X=(Y+/−1).

14. The cartridge as set out in claim 1, wherein the plurality of first protrusions comprises an initial protrusion adjacent to the first opposed end portion of the housing and a last protrusion adjacent to the second opposed end portion of the housing.

15. The cartridge as set out in claim 1, wherein the plurality of second protrusions comprises an initial protrusion adjacent to the first opposed end portion of the housing and a last protrusion adjacent to the second opposed end portion of the housing.

16. The cartridge as set out in claim 1, wherein the base comprises a length defined in the longitudinal direction and wherein the length of the first protrusions is greater than the length of the base, such that the first protrusions extend outward from a front edge of the base.

17. A cartridge for a razor comprising a housing comprising:

first and second opposed end portions spaced apart in a lateral direction of the cartridge;

front and back portions spaced apart in a longitudinal direction of the cartridge, the longitudinal direction being perpendicular to the lateral direction; and a structure defining the front portion of the housing, the structure comprising:

a base having a length defined in the longitudinal direction;

a plurality of first protrusions having a first elongated length defined in the longitudinal direction a first width defined in the lateral direction, and a first height defined in a Z-direction, wherein the Z-direction is perpendicular to both the lateral and longitudinal directions and wherein the first elongated length of the first protrusions is greater than the length of the base, such that each of the first protrusions extend outward from a front edge of the base; and a plurality of second protrusions having a second elongated length defined in the longitudinal direction such that each of the second protrusions extend outwardly from the front end of the base, a second width defined in the lateral direction, and a second height defined in the Z-direction, wherein the second elongated length is less than the first elongated length;

wherein one or more of the first protrusions are positioned between at least one set of adjacent ones of the second protrusions.

18. The cartridge as set out in claim 17, wherein the first and second protrusions are arranged such that the first protrusions alternate with the second protrusions in the lateral direction.

19. The cartridge as set out in claim 17, wherein pairs of the first protrusions alternate with pairs of the second protrusions.

20. The cartridge as set out in claim 17, wherein one of either the first or the second protrusions alternate with pairs of the other of the first or the second protrusions.

21. The cartridge as set out in claim 17, wherein the structure further comprises a plurality of third protrusions, each of the third protrusions defining:

a width in the lateral direction;

a length in the longitudinal direction;

a height in the Z-direction; and a peak at a highest point of a tip of the protrusion as measured in the Z-direction; wherein one of the width, length, or height of the third protrusions is different from the widths, lengths, or heights of each of the first and second protrusions, and wherein a pattern comprises alternating first, second and third protrusions.

22. The cartridge as set out in claim 17, wherein the plurality of first protrusions comprises an initial protrusion adjacent to the first opposed end portion of the housing and a last protrusion adjacent to the second opposed end portion of the housing.

23. The cartridge as set out in claim 17, wherein the plurality of second protrusions comprises an initial protrusion adjacent to the first opposed end portion of the housing and a last protrusion adjacent to the second opposed end portion of the housing.

* * * * *